US008479530B2

(12) United States Patent
Mogilevsky

(10) Patent No.: US 8,479,530 B2
(45) Date of Patent: Jul. 9, 2013

(54) HEAT EXCHANGER FOR USE IN COOLING LIQUIDS

(76) Inventor: Mikhail Mogilevsky, Thornhill (CA)

( * ) Notice: Subject to any disclaimer, the term of this patent is extended or adjusted under 35 U.S.C. 154(b) by 200 days.

(21) Appl. No.: 12/876,042

(22) Filed: Sep. 3, 2010

(65) Prior Publication Data

US 2011/0011117 A1 Jan. 20, 2011

Related U.S. Application Data

(63) Continuation of application No. 11/571,179, filed as application No. PCT/CA2005/000986 on Jun. 23, 2005, now Pat. No. 7,788,943.

(30) Foreign Application Priority Data

Jun. 23, 2004 (CA) ..... 2471969

(51) Int. Cl.
*F25D 21/06* (2006.01)

(52) U.S. Cl.
USPC ..... 62/284; 62/354

(58) Field of Classification Search
USPC ..... 62/354, 184, 525, 284, 412; 165/168, 165/170
See application file for complete search history.

(56) References Cited

U.S. PATENT DOCUMENTS

| | | | | |
|---|---|---|---|---|
| 3,863,462 | A | 2/1975 | Treuer | |
| 4,130,996 | A * | 12/1978 | Sult | 62/113 |
| 4,271,682 | A | 6/1981 | Seki | |
| 4,669,277 | A | 6/1987 | Goldstein | |
| 5,157,939 | A | 10/1992 | Lyon et al. | |
| 5,307,646 | A * | 5/1994 | Niblock | 62/345 |
| 5,363,659 | A | 11/1994 | Lyon et al. | |
| 5,632,159 | A | 5/1997 | Gall et al. | |
| 5,918,477 | A | 7/1999 | Gall et al. | |
| 6,166,907 | A * | 12/2000 | Chien | 361/699 |
| 7,316,263 | B2 | 1/2008 | Lofland et al. | |
| 2005/0229630 | A1 * | 10/2005 | Richter et al. | 62/507 |

FOREIGN PATENT DOCUMENTS

| | | |
|---|---|---|
| CA | 1331287 | 8/1994 |
| WO | WO 85/03996 | 9/1985 |

* cited by examiner

*Primary Examiner* — Mohammad M Ali
(74) *Attorney, Agent, or Firm* — Klein, O'Neill & Singh, LLP

(57) ABSTRACT

A heat exchanger has at least one inlet and outlet to permit circulation of refrigerant therethrough. Each heat exchanger includes a plurality of thin sections of material arranged between a pair of thin flat outer plates. Each of the thin sections of material is comprised of parallel flow paths, allowing for the refrigerant to flow through the inlet, then from one section to the next, and finally out the outlet. The arrangement of the sections of parallel flow paths allows for the refrigerant to come into contact with the majority of the inside wall of the outer plates, allowing for maximum heat exchange. In use for cooling liquids, the heat exchangers are arranged within a frame and brought into contact with the liquid to be cooled. When the heat exchangers are used to cool liquid sufficiently to produce ice crystals, a rotating scraping device sweeps across the surface of the heat exchanger, removing any ice crystals that have formed.

13 Claims, 21 Drawing Sheets

HEAT EXCHANGER FOR USE IN COOLING LIQUIDS

CROSS-REFERENCE TO RELATED APPLICATIONS

This application is a continuation of co-pending application Ser. No. 11/571,179, filed Dec. 22, 2006; which is a national phase filing, under 35 U.S.C. §371(c), of International Application No. PCT/CA2005/000986, filed Jun. 23, 2005, the disclosure of which is incorporated herein by reference.

FIELD OF THE INVENTION

The present invention relates to heat exchangers for cooling liquids.

BACKGROUND OF THE INVENTION

Ice making machines and chillers are well known. These types of machines are used in a number of industries including the food processing, plastics, fishing, and general cooling applications. Chillers cool liquids generally to a point above their freezing temperature, while ice making machines generally cool water or a solution below its freezing point. Ice machines and chillers use a heat exchanger that is generally cooled by refrigerant that flows through internal passages. Water, or any other liquid to be cooled, is introduced onto the surface of the heat exchanger. If the liquid is frozen, a variety of methods are then used to remove the ice from the heat exchange surface, including using a scraping device, or heating the surface temporarily to release the ice. Slurry ice differs from flake ice in that the water that is frozen usually has mixed with it salt, or some other substance, for altering the freezing point. The resulting slurry product has a slush consistency and may be pumped, making it preferred for many applications where the end product must be conveyed. Furthermore, its energy storage and transfer characteristics are superior to other types of ice.

U.S. Pat. Nos. 5,157,939 and 5,363,659 by Lyon, as well as U.S. Pat. No. 5,632,159 and U.S. Pat. No. 5,918,477 by Gall disclose heat exchangers in the shape of a disk with internal passageways for the refrigerant to travel along the interior of the disk. The disk rotates in contact with a fixed scraping mechanism which removes ice formed on its surface. In Lyon the disk is formed with two mating disk halves, each of which includes a plurality of grooves on its internal surface. The pattern of the grooves in the two halves are mirror images, so that when the halves are mated and brazed together, corresponding grooves mate to form passages. The manufacturing of this heat exchanger involves chemically etching each separate half of the disk, which is expensive.

The two devices by Gall disclose a heat exchanging device that is formed by cutting fluid passages into a thick metal plate using a milling machine. Once the passages are cut, a thin flat plate is joined to the milled plate to complete the disk. Although milling the plate is not as expensive as chemically etching it, and in this process only one plate is being machined as opposed to both, this is still a lengthy and expensive process. In the prior art flat disk heat exchangers, the refrigerant does not come into contact with a significant portion of the heat exchange surface. The reason for this is that there needs to be sufficient material between the channels to provide a large enough surface area for brazing in order to withstand pressure.

The refrigerant in heat exchangers disclosed in prior art is introduced into the heat exchanger through a single inlet and removed through a single outlet. The refrigerant is driven by the compressor through the internal passages. There is an optimal range of velocity for the refrigerant: If velocity is too small, the heat transfer efficiency decreases, and there will not be sufficient velocity to carry oil, which is picked up from the compressor, back to the reservoir of the compressor. If velocity is too large, the compressor will waste energy.

Having a single inlet and single outlet forces all of the mass of the refrigerant to pass through a small cross sectional area. For a fixed mass flow of refrigerant, a smaller cross sectional flow area corresponds to a larger velocity. Thus, by having a single inlet and outlet, the channel length and the velocity are increased, and therefore the work of the compressor which moves the refrigerant in the ice machine system is significantly increased. In the heat exchanger of the prior art, the only way to reduce the refrigerant velocity is to increase the cross-sectional area, which increases the cost of manufacturing.

It would therefore be advantageous to have an ice making machine with a heat exchanger that has a lower pressure drop across it, as well as a velocity of the refrigerant that can be reduced to an optimal range.

It would be further advantageous to have a heat exchanger for use in a chiller or ice machine that can be made in an inexpensive manner.

It would be further advantageous to have a heat exchanger in which the refrigerant passageways allow for the refrigerant to come into a greater degree of thermal contact with the majority of the disk surface, to improve heat transfer.

It would be further advantageous to have a flat plate heat exchanger in which the outer walls were thin so as to provide high heat transfer, but were still able to withstand high pressures of the refrigerant.

Another need is to provide an ice making machine with flat plate heat exchangers that allow simultaneous scraping of several heat exchange surfaces with a single driving motor and little additional power for each additional surface.

There is yet a further need to provide a scraping mechanism for an ice making machine that is simple, robust and easy to service, and requires little clearance to service.

SUMMARY OF THE INVENTION

In another aspect, the invention is directed to an apparatus for heat exchange, comprising at least one fluid inlet, at least one fluid outlet, a first outer plate and a second outer plate, and an inner layer. The inner layer is sealedly sandwiched between the first and second outer plates. The inner layer at least in part defines at least one series of fluid channels. Each fluid channel is defined in part by the inner surface of one of the outer plates and by the inner layer. The at least one series of fluid channels makes up at least one flow path between the at least one fluid inlet and the at least one fluid outlet.

In another aspect, the invention is directed to an apparatus for heat exchange, comprising at least one fluid inlet, at least one fluid outlet, a first outer plate and a second outer plate, and an inner layer. The inner layer is sealedly sandwiched between the first and second outer plates. The inner layer at least in part defines at least one flow path between the at least one fluid inlet and the at least one fluid outlet. The inner layer may optionally include a plurality of sections that each define one or more segments of the flow path. The sections mate together in a puzzle-like configuration to make up a flow portion of the inner layer.

In one aspect, an embodiment of the invention comprises a chiller or ice machine with an apparatus for heat exchange. The heat exchange apparatus includes flat top and bottom plates of generally the same shape, at least one fluid inlet and at least one fluid outlet, each located at a point near or on the edge of the plates, as well as a plurality of sections in a puzzle-type arrangement between the top and bottom plates. Each of the sections comprises a thin piece of material with parallel flow channels. The puzzle-type arrangement of the sections allows for the fluid to flow continuously from the inlet, through the different sections, and out the outlet. An additional feature of this embodiment is that the sections are configured so that the majority of the inner surfaces of the top and bottom plate come in to contact with the fluid flowing through the sections. In one embodiment of the invention, the sections of parallel flow channels are corrugated material, and the puzzle-type arrangement is symmetrical within the plates. Additionally, each inlet and outlet is dimensioned so that the fluid flows through a significant number of flow channels. In an advantageous embodiment, there are two inlets and two outlets, each of which is evenly spaced along the edge of the top or bottom plate. In the aforementioned embodiment, the top and bottom plates each include an inner ring and outer ring portion, where the inner and outer ring extend beyond the sections of flow channels. The flow path of the fluid through the sections preferably includes the fluid flowing in through the inlet and in towards the inner ring, then flowing around the inner ring towards the outlet, before being directed back and forth, first towards the inlet, then towards the outlet, along paths successively closer to the outer ring and finally, through the outlet.

Another feature of the present invention is an apparatus for scraping material from between two plates, which comprises a shaft passing perpendicularly through the centre of the plates, a hollow carrier positioned between the plates with a length sufficient to reach the edge of the plates, a plurality of scrapers positioned along the length of the carrier, an inner carrier with means to secure it to the shaft and positioned so the inner carrier is in sliding engagement within the hollow carrier, means for rotating the shaft, and removable means to connect the inner carrier to the hollow carrier. In one embodiment the securing means is a plate welded to the inner carrier and bolted to the shaft. As well, the removable connecting means may be a bolt that can be removed so the hollow carrier may slide out. The shape of the scraping apparatus is preferably such that the apparatus is reversible so that when the edge that is in contact with the heat exchange surface wears out, the opposite edge may be used, thereby extending the life of the scraping mechanism.

In another aspect, the invention is an ice making apparatus that comprises a frame, a plurality of flat plate heat exchangers arranged parallel within the frame, means for continuously supplying a solution over the heat exchangers, and scraping means for removing ice crystals that form on the surface of the heat exchangers. In one embodiment, insulation panels are secured to the frame to create a generally sealed compartment.

In another aspect, the present invention relates to a method for establishing an overall continuous flow path from an inlet to an outlet through an apparatus for heat exchange, occupying substantially all of the surface area between the inlet and outlet, comprising the steps of: providing a plurality of sections, where each section is made up of a parallel set of flow channels; cutting each section at one or more angles to selected groups of parallel flow channels; abutting edges of each section to one or more other sections, thereby causing the flow path to change direction; and assembling the sections in a puzzle-like configuration. Each section may include all contiguous and parallel channels at any given point, whereby a section may include parallel flow paths in opposite directions to one another.

Other aspects and advantages of the device will become apparent from the following Detailed Description and the accompanying drawings.

DETAILED DESCRIPTION OF THE EMBODIMENT

Figure 3:
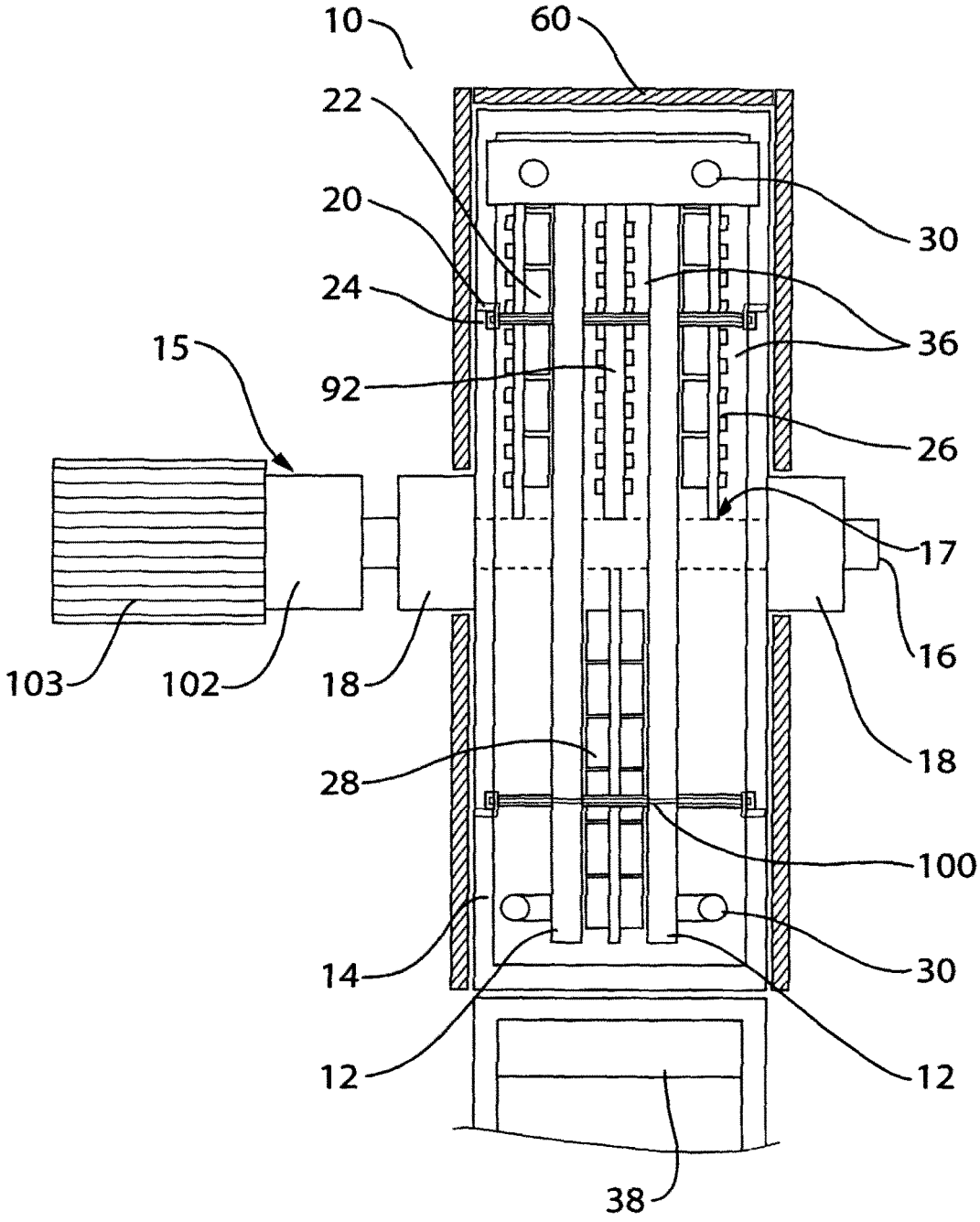
FIG. 3 is a cross-sectional view taken along line 3-3 in FIG. 2.
Figure 12A:
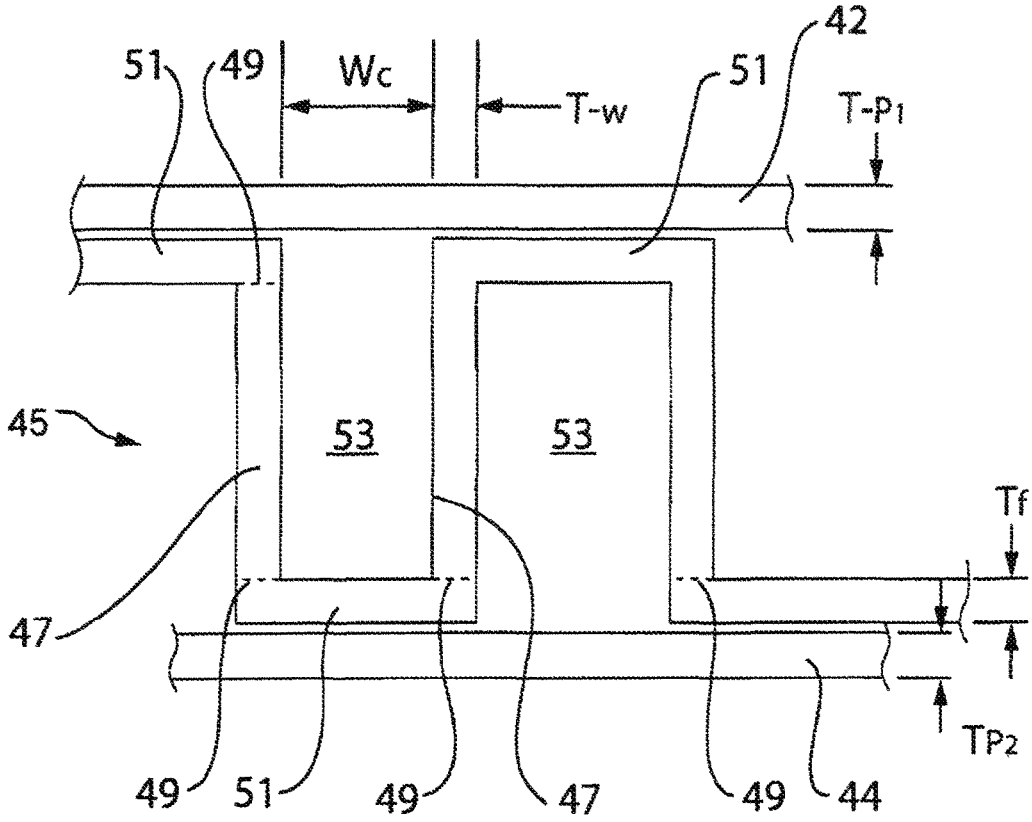
FIG. 12*a* is a magnified sectional side view of a portion of the heat exchanger shown in FIG. 1.

Reference is made to FIG. 3, which shows an ice-making machine 10 in accordance with a first embodiment of the present invention. The ice making machine 10 comprises a plurality of flat plate heat exchangers 12 within a support frame 14, a scraping system 15 and a liquid supply system 17. Referring to FIG. 12*a*, each heat exchanger is made up of a first outer plate 42, a second outer plate 44 and an inner layer 45 positioned between the first and second outer plates 42 and 44. The inner layer 45 includes a plurality of wall portions 47 each of which has two longitudinal edges 49. Along one or both of the longitudinal edges 49, a foot portion 51 may be integrally joined to the wall portion 47. The one or two foot portions 51 join the wall portions 47 to one or both of the outer plates 42 and 44. When joined to the outer plates 42 and 44, the wall portions 47 separate and define flow channels 53, which are used for the transport of a refrigerant through the heat exchanger 12. The channels 53 are arranged to provide a flow path of the refrigerant between one or more refrigerant inlets 32 and one or more refrigerant outlets 34. In the exemplary embodiment shown in FIG. 1, the heat exchanger 12 is shown having two inlets 32 and two outlets 34, however, it is alternatively possible for the heat exchanger 12 to have fewer or more inlets 32 and outlets 34.

A flow path is understood to comprise the all of channels formed by the sandwich between the outer plates and inner layer that lead from a fluid inlet to a cooperating fluid outlet. By contrast, the term flow path "segment" is use to define a portion of the flow path between an inlet and outlet, it being understood that only a series of adjacent channels that are aligned in parallel arrangement throughout the length the flow path (through all of the inner layer sections participating in the flow path segment) belong to the same segment.

Reference is made to FIG. 12*a*. By joining the wall portion 47 to the outer plates 42 and 44 using the foot portions 51, several advantages are obtained. One advantage is that the wall portion 47 may be made relatively thin, so that a relatively greater number of wall portions 47 and associated foot portions 51 may be positioned between the outer plates 42 and 44. This in turn provides a relatively greater number of structural members between the first and second outer plates 42 and 44. This, in turn, configures the heat exchanger 12 to resist deformation of the heat exchanger when refrigerant is circulated through the channels 53 under pressure.

The heat exchanger 12 may be expected to be pressurized to between about 30 psig (207 kPa) and about 300 psig (2070 kPa), and may thus be configured to withstand at least up to about 300 psig (2070 psi). However, in some jurisdictions, the heat exchanger 12 may be required to withstand pressures that are higher than their expected maximum internal pressure during use. For example, the heat exchanger 12 may be configured to withstand as much as approximately 450 psig (3100 kPa) to meet local regulations in some jurisdictions.

By having relatively thin wall portions 47, the overall surface areas of the plates 42 and 44 that are in contact with the wall portions 47 are relatively low. This permits relatively greater contact surface area between the plates 42 and 44 and the channels 53, which facilitates maintaining the plates 42 and 44 at selected temperatures. The thickness of the wall portions 47 is shown at Tw. The thickness Tw may be, for example, approximately 0.008" (0.2 mm). The channel width between adjacent channel-defining pairs of wall portions 47, is shown at Wc, and may be approximately 3/16" (4.8 mm). It is understood that the channel width Wc need not be uniform and that term "channel width" refers to the portion of the channel 53 wherein there is a fluid contact interface with the outer plates 42 and 44.

The ratio of the wall portion thickness Tw to the channel width Wc may be less than approximately 1:8, is more preferably between approximately 1:18 and approximately 1:25, more preferably less than approximately 1:20, and may be between approximately 1:20 and approximately 1:25, such as for example approximately 1:22.5.

By having a relatively greater number of structural members (ie. the wall portions 47) between the first and second plates 42 and 44, the thicknesses of the first and second plates 42 and 44 may be kept relatively low. The thicknesses of the first and second plates 42 and 44 are shown at Tp1 and Tp2 respectively. The thicknesses Tp1 and Tp2 may each be approximately 0.120" (3 mm) or less.

The foot portions 51 that are connected to the wall portions 47 have a thickness Tf, that may be the same as the thickness Tw of the wall portions 47. The foot portions 51 are preferably relatively thin so that they interfere relatively little in the cooling of material deposited on the outer surfaces of the outer plates 42 and 44. The foot portions 51 permit the joining of the wall portions 47 to the first and second outer plates 42 and 44 over a relatively large surface area, thus providing a relatively secure and sealed joint, while simultaneously permitting the wall portions 47 to be relatively thin.

Figure 13:
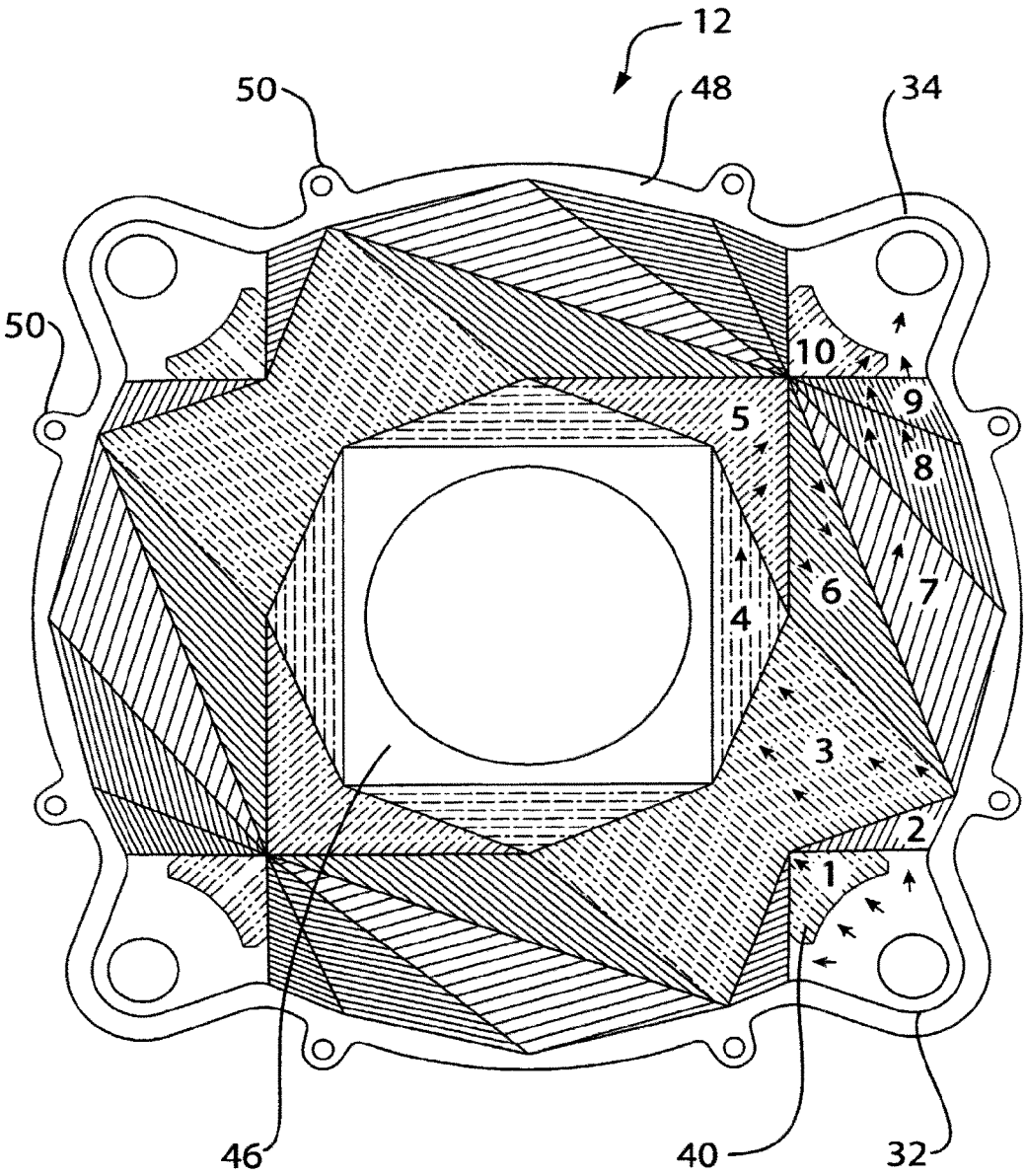
FIG. 13 is a top view of the sections of another alternative puzzle-type arrangement between the plates.

The wall portions 47 and foot portions 51 may be integrally formed together in a section 40 of corrugated sheet material. A plurality of such sections 40 may be mated together so that the channels 53 direct the refrigerant along a set of selected parallel flow paths between the inlets 32 and the outlets 34. The flow paths may he made to be generally serpentine to increase the amount of heat transfer that takes place per unit volume of refrigerant that flows through the heat exchanger 12. The term 'serpentine' is used to refer to a flow path segment wherein the direction is gradually (using a plurality of 90 to 180 degree interfaces at the section borders) or immediately (using at least one acute angle section interface) partially reversed at least once in a v-like pattern, and usually multiple times in an undulating pattern. For example, as shown in FIG. 13, the v-like pattern of channels at the section interfaces may be repeated multiple times in a single flow path segment.

Making the inner layer 45 from a plurality of mating sections 40 of corrugated sheet material provides a selected routing for the flow paths, provides a relatively thin walled structure, both in terms of the wall portions 47 and in terms of the outer plates 42 and 44, and also provides a relatively inexpensive way of incorporating these advantageous features into the heat exchanger 12. The sections 40 mate together in a puzzle-like configuration, though their shapes in plan view are not limited in any way to traditional puzzle-piece shapes.

Figure 12B:
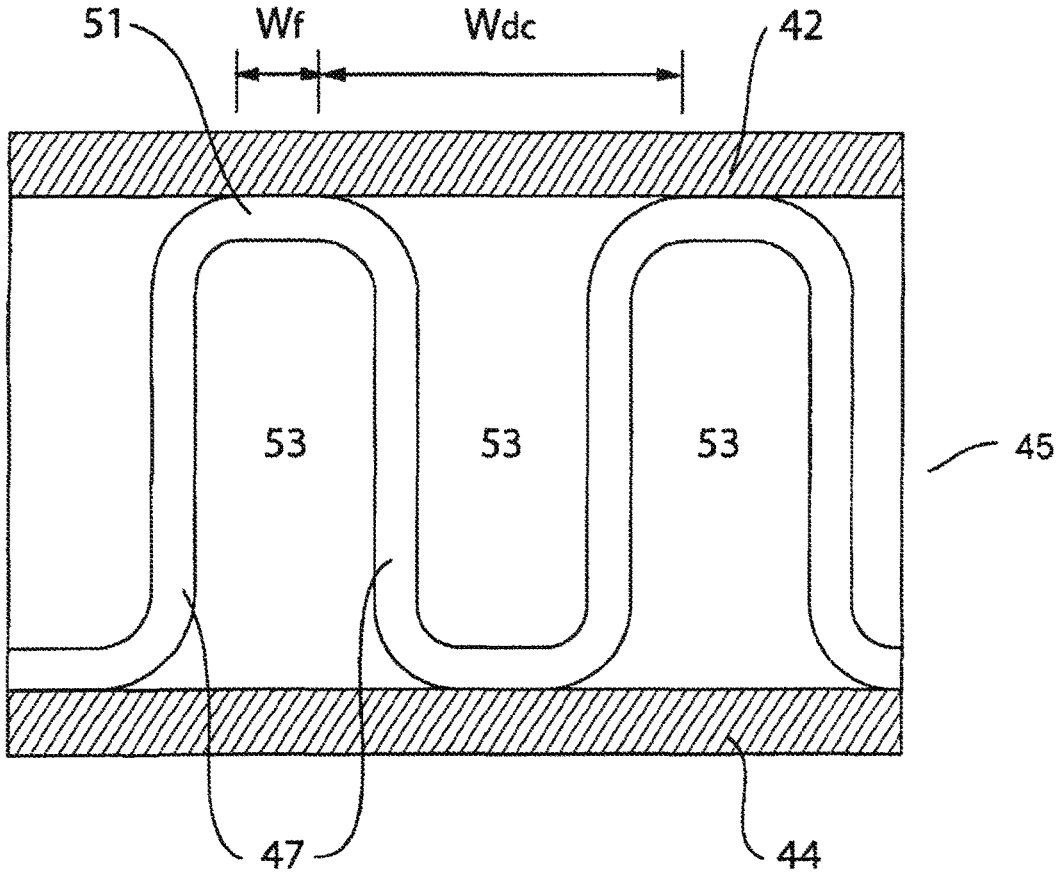
FIG. 12*b* is a magnified sectional side view of an alternative configuration of the portion of the heat exchanger shown in FIG. 12*a*.

The term "corrugated" is used broadly to define an undulating pattern of bends which serve to define the height and width of the channels through which fluid flows through the heat exchanger. The shape formed by the bends is important to the extent that it defines the dimensions of the channel including an at least partially coplanar surface relative to the outer plates 42 and 44. This coplanar surface, referred to herein as the foot portions 51 of the channel walls, has a width Wf that relates to an available contact surface sufficient to form a joint with the outer plates 42 and 44, when the corrugated sheet material layer is sealedly joined to the outer plates, for example by brazing. This contact area is maximized when the bends are formed at 90 degrees, however it will be appreciated that bends having a partially curvilinear profile could be used to advantage albeit with a somewhat lesser contact surface. It will be appreciated that the smaller the foot portions 51 are, the greater the surface area of contact that exists directly between the refrigerant and the outer plate 42 or 44 (see FIG. 12*b*). Thus, the configuration of the corrugations can be selected to provide a selected tradeoff between the amount of sealing surface area and the amount of direct fluid-to-outer plate contact that is desired.

Figure 1:
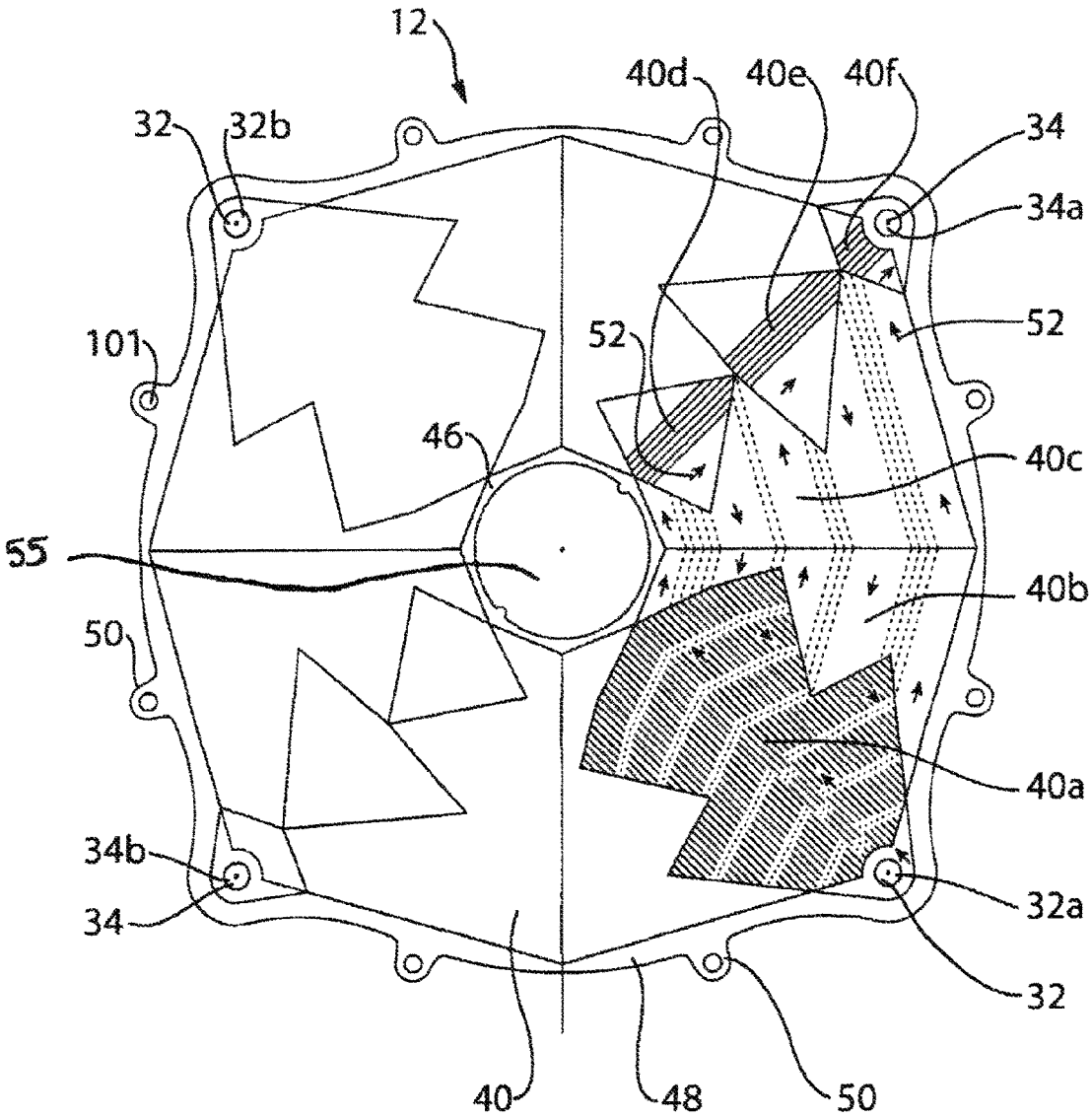
FIG. 1 is a transparent front view of a heat exchanger in accordance with an embodiment of the present invention.
Figure 11:
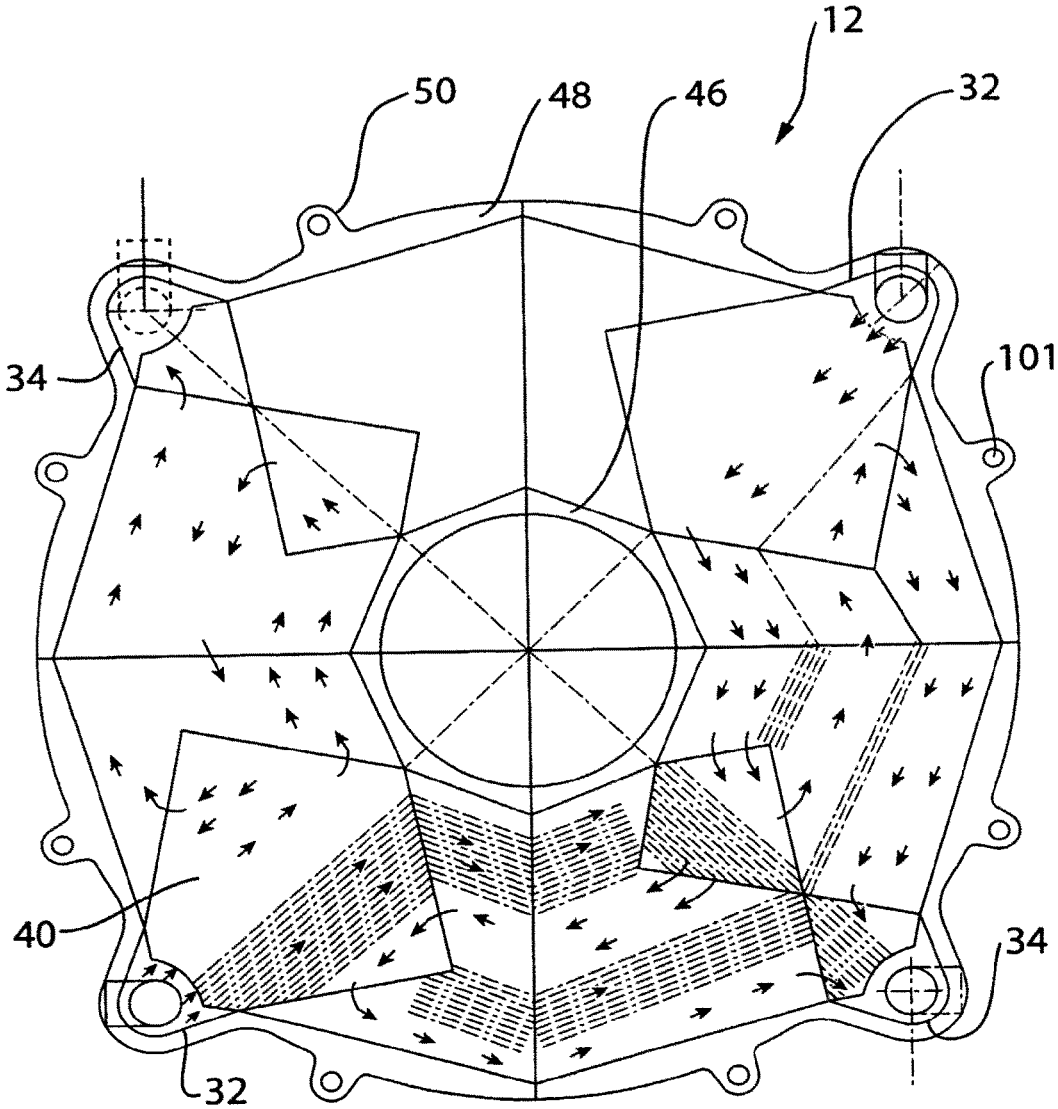
FIG. 11 is a top view of the sections in an alternative puzzle-type arrangement between the plates.
Figure 11A:
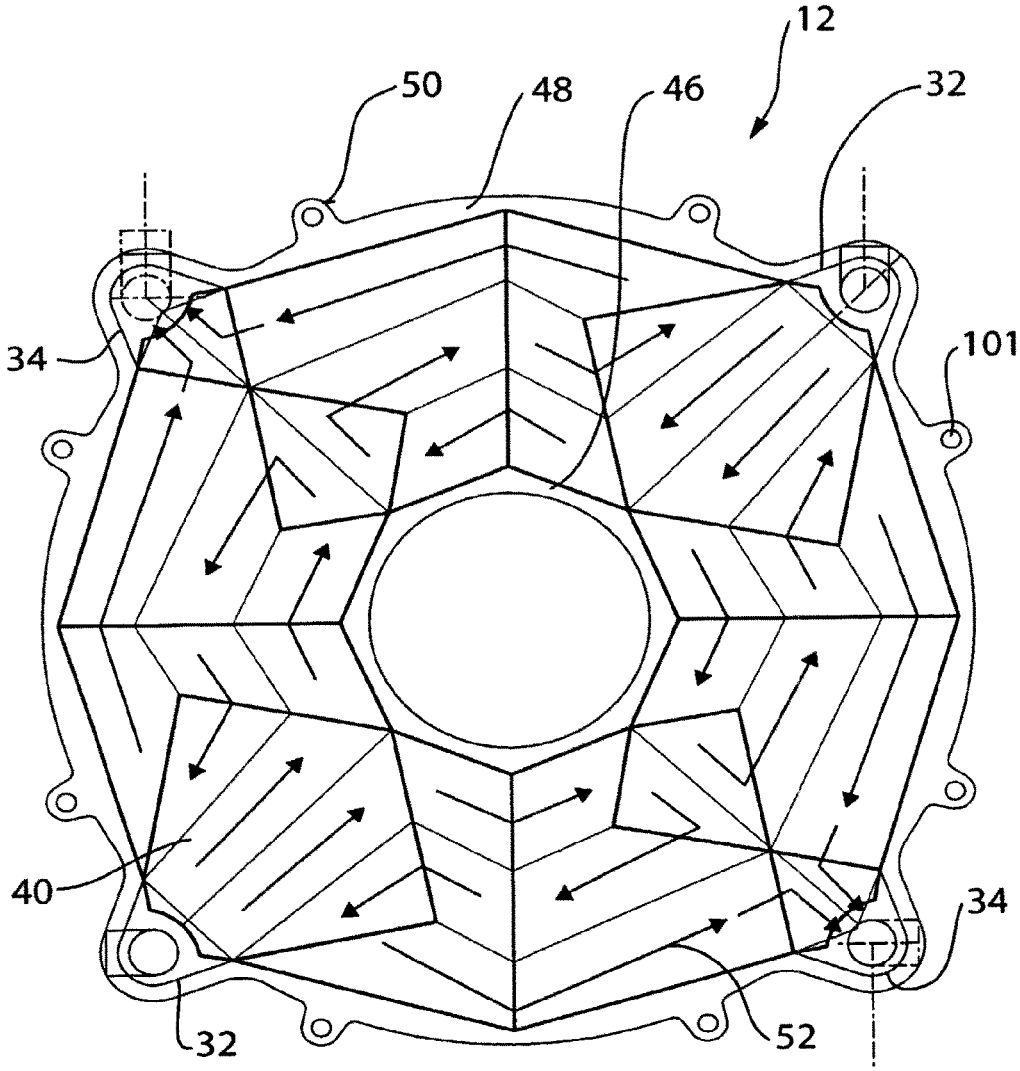
FIG. 11*a* is a transparent view of the heat exchanger shown in FIG. 11, with individual flow channels removed for clarity to illustrate flow paths taken by refrigerant through the heat exchanger.
Figure 14:
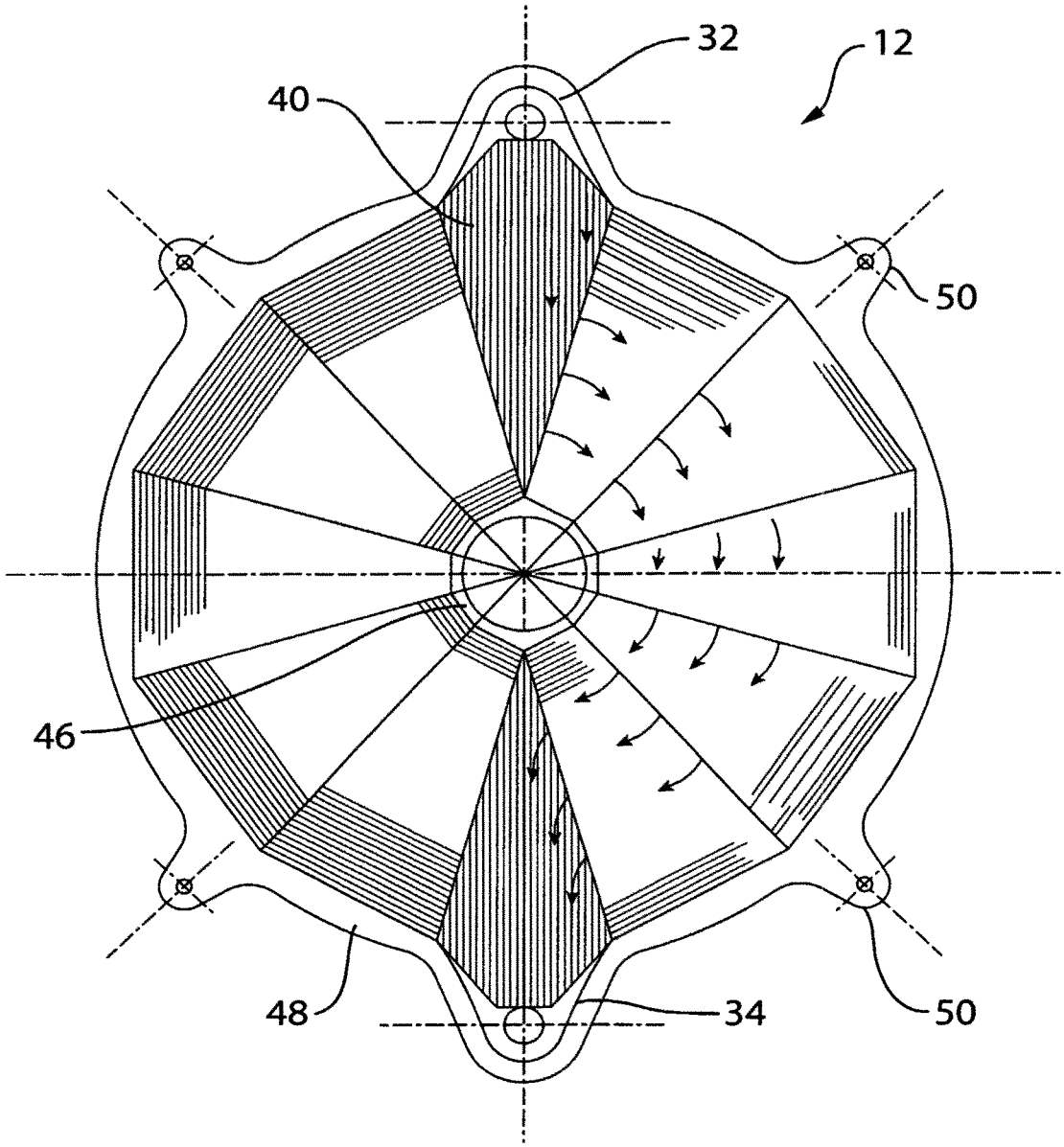
FIG. 14 is a top view of the sections in puzzle type arrangement when the device has only one inlet and one outlet.
Figure 15:
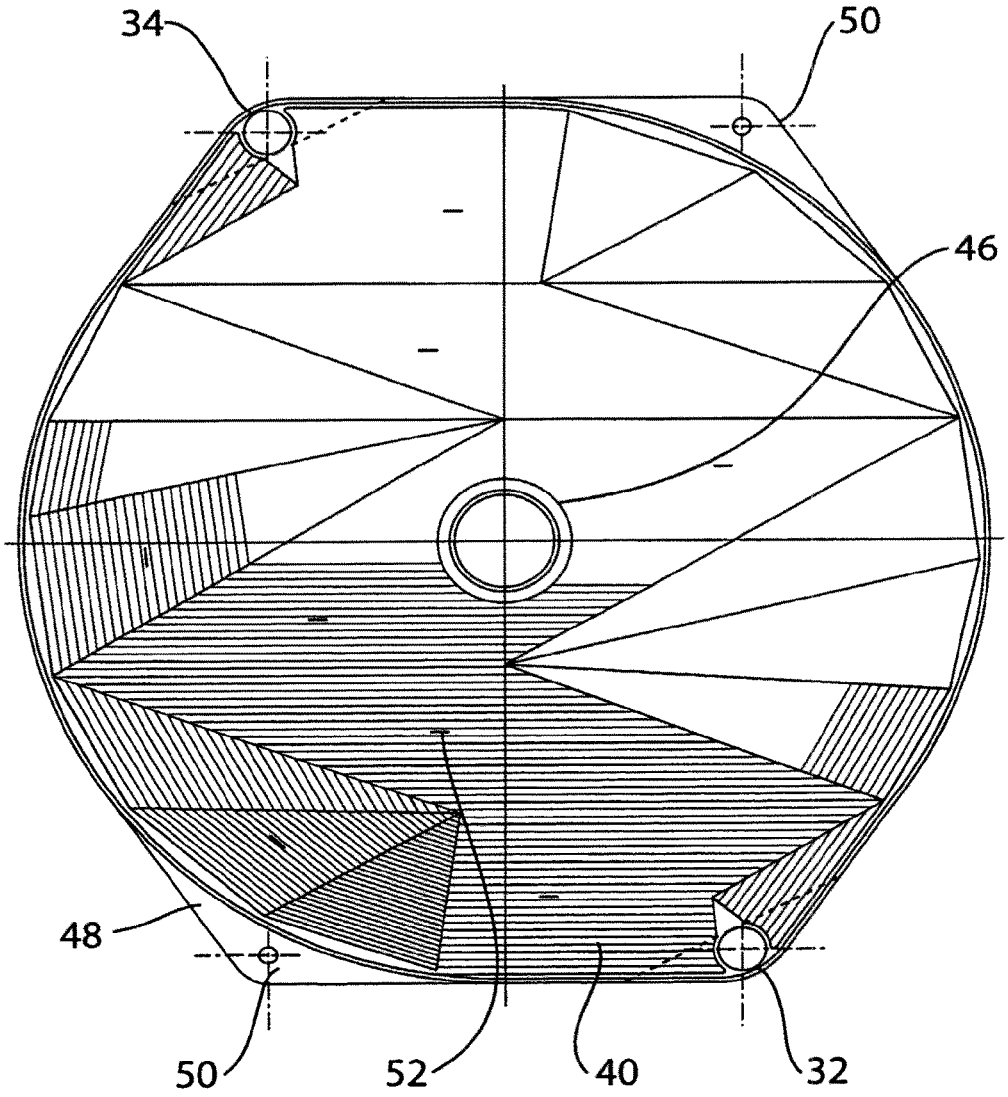
FIG. 15 is a top view of another puzzle-type arrangement of the sections when there is only one inlet and outlet.

A selected configuration of sections 40 is provided in FIG. 1. Additional configurations of sections 40 which provide different flow paths between one or more inlets 32 and one or more outlets 34 are shown in FIGS. 11, 13, 14 and 15. More specifically, FIGS. 1 , 11 and 13 show a heat exchanger 12 with a set of flow paths between two inlets 32 and two outlets 34. FIGS. 14 and 15 show a heat exchanger 12 with a set of flow paths between one inlet 32 and one outlet 34.

Each section 40 may be cut at a non-zero angle relative to one or more adjacent sections 40, so that when the sections are mated together along their outer edges, the channels 53 formed by the corrugations change direction from one section 40 to the other section 40. The second section 40 is abutted to another section 40 to change the flow direction again, and so on, to establish an overall flow path from the inlet 32 to the outlet 34. Each section 40 may include all contiguous and parallel channels at any given point, or a section 40 may include parallel flow paths in opposite directions to one another.

The inner layer 45 may include an outer ring 48 to sealedly join the first and second plates 42 and 44 together about their outer peripheries to prevent the leakage of refrigerant out from the outer peripheries of the heat exchanger 12. Apertured mounting tabs 50 may be provided about the outer ring 48 for the mounting of the heat exchanger 12 on the support frame 14. The tabs 50 may receive therethrough tie rods 100 (FIG. 3) which mount to the frame 14. Spacers 22 may be provided on the tie rods 100 between adjacent pairs of heat exchangers 12 and between the heat exchangers 12 and the frame 14 to fix the one or more heat exchangers 12 in selected positions. The outer ring 48 may extend around the channel portion of the inner layer 45 (ie. the sections 40), and also around the inlets 32 and outlets 34.

The term "sealedly" is used to refer to a property of a three layer sandwich (i.e. the two outer plates 42 and 44 and the inner layer 45) which precludes escape of the heat exchange medium (eg. refrigerant) from the three-layer sandwich when at high pressures, such as pressures in the range of between about 50 psig (340 kPa) to about 300 psig (2070 kPa). Particularly when the medium is a refrigerant it is important to join the layers in such a sealed manner so as to preclude environmental concerns about refrigerant escape out of the heat exchanger 12.

The heat exchanger 12 may have a shaft pass-through aperture 55 therethrough, which permits the drive shaft 16 that is part of the scraper system 15 to pass therethrough for connection to scrapers 26 on both sides of the heat exchanger 12. It is contemplated that for some embodiments, eg. when the heat exchanger is used as a chiller, then the heat exchanger 12 need not have the shaft pass-through aperture 55.

The inner layer 45 includes an inner ring 46 that sealedly joins the first and second plates 42 and 44 together along their inner peripheries about the pass-through aperture 55, to prevent the leakage of refrigerant out from the inner peripheries of the heat exchanger 12.

Each of the heat exchanger components, including the first and second plates 42 and 44, the inner and outer rings 46 and 48 and the sections 40, may be made from a suitable material, such as a metallic material.

The joining of the outer ring 48, the inner ring 46 and the foot portions 51 to the outer plates 42 and 44 may be carried out by any suitable means, such as brazing.

Figure 1A:
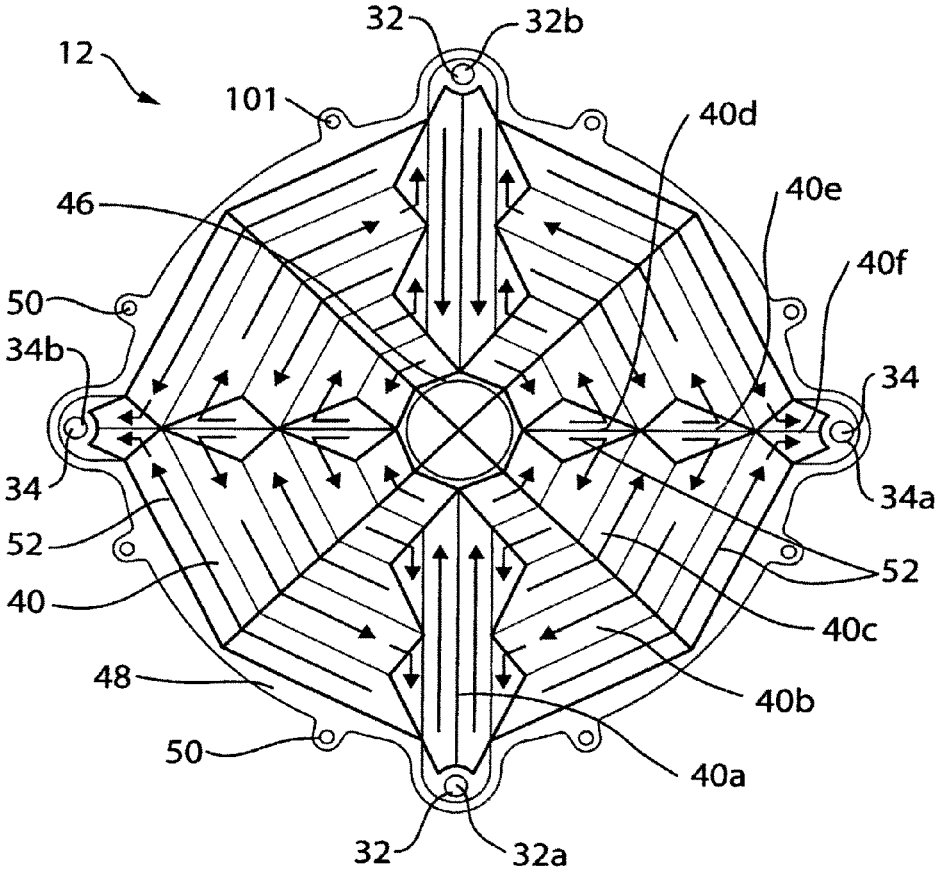
FIG. 1*a* is a transparent view of the heat exchanger shown in FIG. 1, with individual flow channels removed for clarity to illustrate flow paths taken by refrigerant through the heat exchanger.

An exemplary flow path through the puzzle-type arrangement of the sections 40 may be described as follows, with reference to FIGS. 1 and 1*a:* Refrigerant enters the heat exchanger 12 through the inlet shown at 32*a* and travels along section 40*a* towards inner ring 46. After travelling through section 40*a,* a portion of the refrigerant is directed from the end of the channels 53 in section 40*a* into section 40*b,* changing direction and travelling alongside the inner ring 46. From section 40*b* the refrigerant flows into section 40*c,* and on through into section 40*d,* where the fluid changes direction and flows away from the inner ring 46 for a brief period. The refrigerant flows from section 40*d* back into section 40*c* along a different set of channels than were taken through section 40*c* towards section 40*d.* From section 40*c,* the refrigerant flows back into section 40*b* and then back into section 40*a.* As can be seen by the flow arrows 52, the refrigerant continues passing through the sections 40 until it reaches the outlet shown at 34*a.* The flow path shown between the inlet 32*a* and 34*a* runs through one quarter of the heat exchanger 12 shown in FIG. 1 . It will be noted that some portion of the refrigerant that enters the heat exchanger 12 also flows to the outlet shown at 34*b* in another quarter of the heat exchanger 12. Refrigerant also flows in a similar pattern through the inlet shown at 32*b,* to each of the outlets 34*a* and 34*b.*

It will be noted that in at least some of the sections 40, such as section 40*b,* the refrigerant travels along some channels 53 in one direction, and along other channels in the opposite direction.

Additionally, it will be noted that, in the joints between at least some pairs of adjacent sections, such as the joint between a portion of sections 40*d* and 40*c,* the channels 53 meet at acute angles, such that the refrigerant flows back on itself to some extent. By providing at least some of the joints between adjacent sections whereby the channels 53 meet up at acute angles, a serpentine flow path can be provided.

Figure 14A:
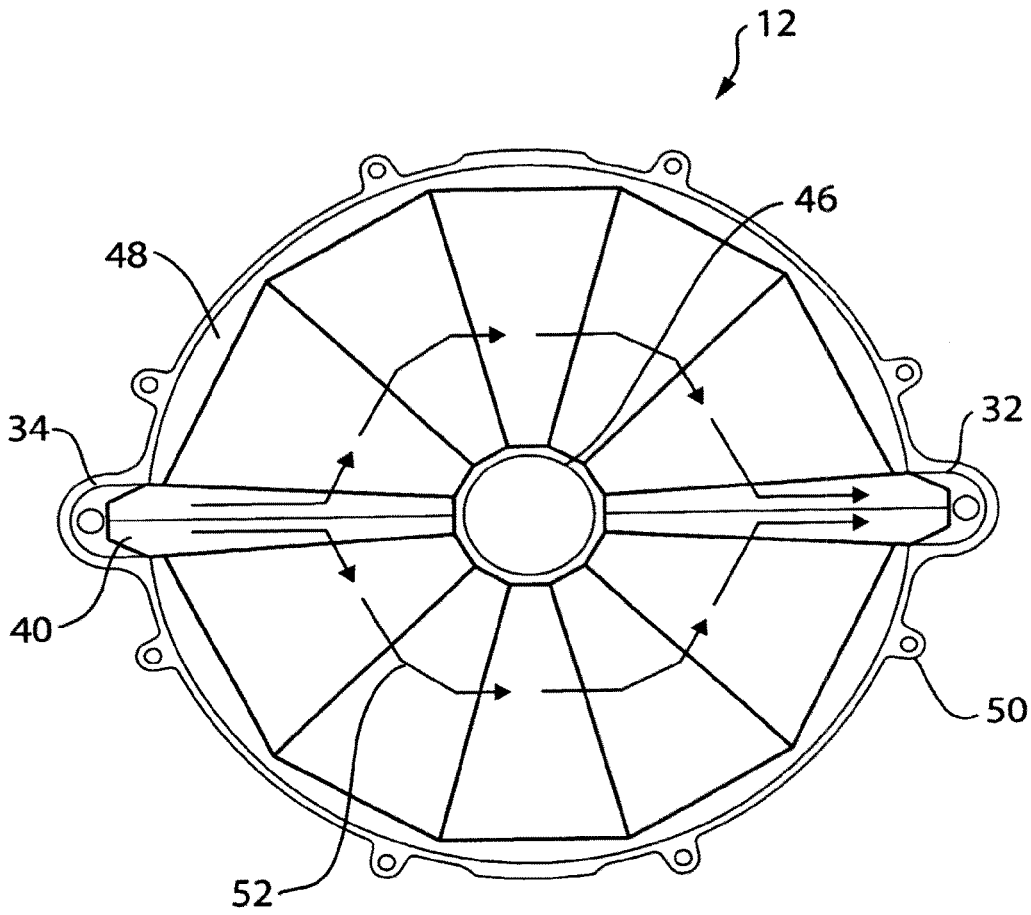
FIG. 14*a* is a transparent view of the heat exchanger shown in FIG. 14, with individual flow channels removed for clarity to illustrate flow paths taken by refrigerant through the heat exchanger.

It will also be noted that, in some other joints between at least some pairs of adjacent sections, such as the joint between sections 40*b* and 40*c,* the channels 53 meet at obtuse angles. Such joints can be provided between successive pairs of adjacent sections 40 to permit a relatively gradual change of direction in the flow path of the refrigerant from one direction to another. For example, the flow path provided by the heat exchanger 12 in FIGS. 14 and 14*a* includes only obtuse angle joints between adjacent pairs of sections 40. In the heat exchanger 12 shown in FIGS. 14 and 14*a*, the overall flow path has a shape that follows the generally annular shape of the heat exchanger 12 and does not double back on itself. By providing at least some joints where channels 53 meet at obtuse angles in adjacent sections 40, the pressure drop incurred in the overall change in flow direction is reduced.

By providing two inlets 32 and two outlets 34, the total distance traversed by each one quarter of the refrigerant is limited to a single quadrant of the heat exchanger. This reduces the overall pressure drop experienced by the total refrigerant flow across the heat exchanger since pressure drop varies proportionally with the path length travelled by the refrigerant.

There are tradeoffs well known in the art when increasing the path length of the refrigerant. On one hand, longer path lengths increase the time the refrigerant has to remove heat from the material it contacts, making its heat transfer more efficient. Shorter paths reduce the pressure required to move the refrigerant and hence make the compressor or whatever is driving the refrigerant flow work less hard. Many puzzle-type arrangements of the sections 40 may be used in the heat exchanger 12. The arrangements shown in FIG. 1 and FIG. 13 have been found to optimize the tradeoff between shorter and longer path lengths for various size units, while providing full coverage of the surface area of the plate.

The inner layer 45 comprises a outer boundary portion, which is made up of the outer ring 48, a flow portion, which may be made up of the sections 40 of corrugated sheet metal, and optionally an inner boundary portion, which is made up of the optionally provided inner ring 46. The flow portion may cover an area that is between approximately 50% to approximately 95% of the area of inner layer 45, depending on certain factors, such as whether or not the heat exchanger 12 has a shaft pass-through aperture 55 and the overall size of the heat exchanger 12. In some embodiments, the flow portion may cover between approximately 75% to approximately 90% of the area of the inner layer 45, and preferably at least approximately 85% of the area of the inner layer 45, and more preferably at least 88% of the area of inner layer 45.

The scraper system 15 will now be described. Passing through the heat exchangers 12 which may be aligned vertically in a generally parallel position is a central shaft 16, which may be supported on the outside of the frame 14, by a pair of bearings 18. The shaft 16 is driven by a motor 103 through a gearbox 102. A plurality of threaded rods 100 pass through apertures 101 in the apertured tabs 50 which are mounted to supporting brackets 20. The rods 100, brackets 20, and spacers 22, may hold the heat exchangers 12 in a vertical position as shown in FIG. 3, and are locked in place by nuts 24.

Figure 4:
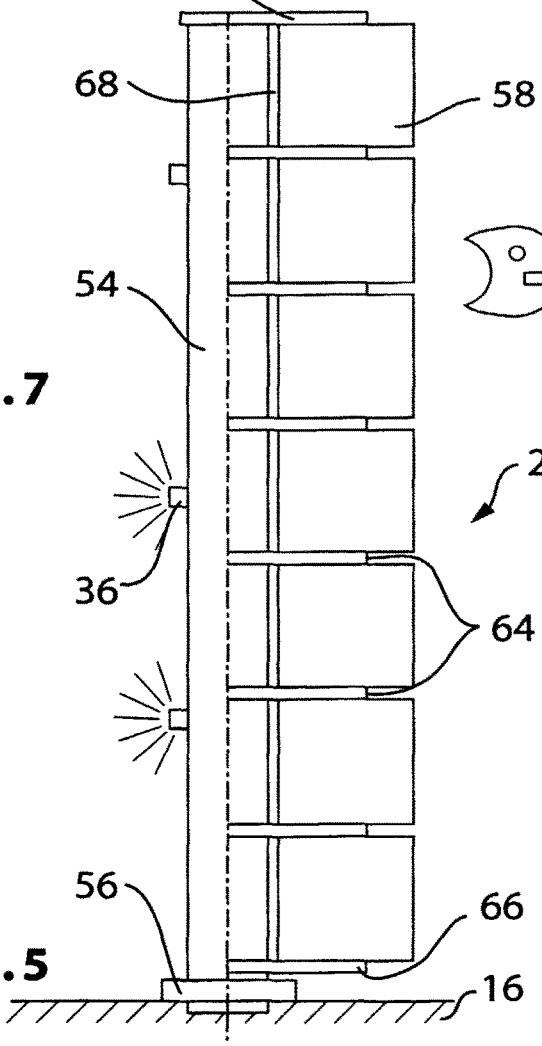
FIG. 4 is a side view of a scraping device for scraping one side of a plate.
Figure 6D:
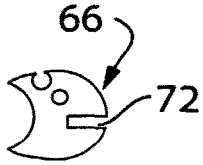
FIG. 6D is a top view of the bottom web of a scraper.
Figure 9A:
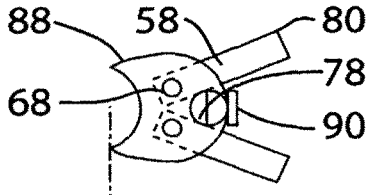
FIG. 9A is a top view of the web from the scraping device in FIG. 7 with a pair of scrapers connected to it.
Figure 9B:
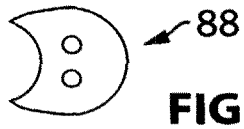
FIG. 9B is a top view of the web from FIG. 9A without the scrapers.
Figure 8:
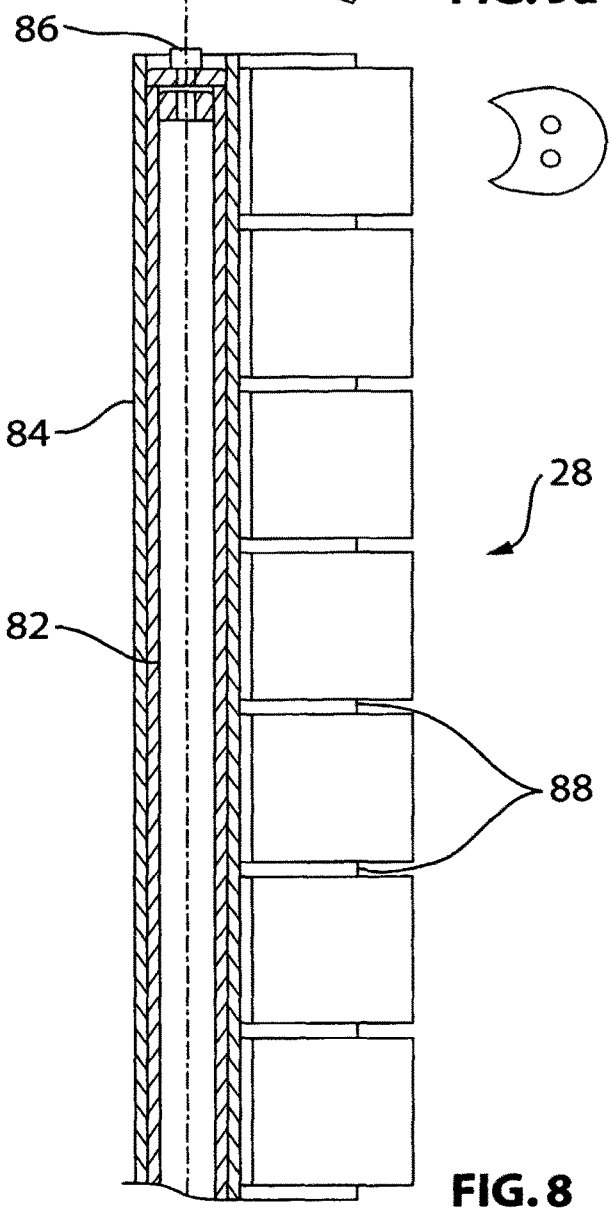
FIG. 8 is a side view of the scraping device used between two plates.

Between the outermost heat exchanger and the frame 14 is positioned an outer scraping device 26, shown in FIG. 4, while the inner scraping device 28 shown in FIG. 8 is positioned between two heat exchangers 12.

Figure 2:
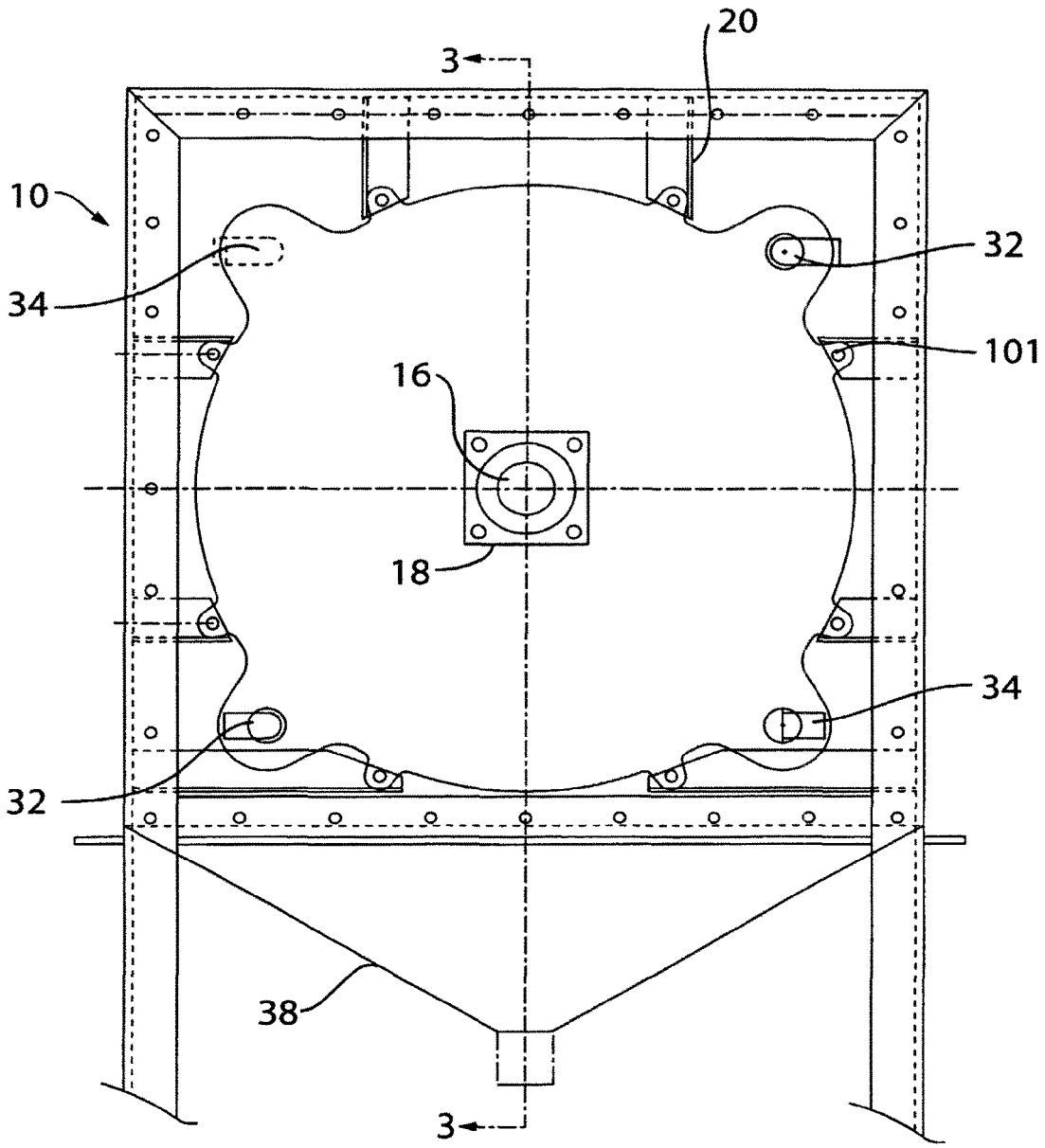
FIG. 2 is a front view, partially in phantom, of an ice making machine in accordance with another embodiment of the present invention, incorporating the heat exchanger shown in FIG. 1.

The refrigerant enters the machine 10 through a plurality of connections 30 (FIG. 3), and is then pumped into each heat exchanger 12 through the inlets 32 (FIG. 2). Once the refrigerant has passed through the heat exchanger 12, it then exits through outlets 34 (FIG. 2) and back out through connections 30 (FIG. 3). Fresh water, salt water or any other liquid to be cooled is pumped into the machine 10 through the shaft 16, then sprayed over the surface of the heat exchangers 12 from nozzles 36. For a scraping device 26 that scrapes the outermost heat exchanger, nozzles 36 are disposed on the rear section of the scraper 26. While it is possible to place nozzles 36 on a scraping mechanism 28 that scrapes two plates simultaneously, it is preferable to place them on a separate spraying tube 92. The scraping devices 26, 28 are then rotated by the shaft 16, removing the ice-water mixture from the surface of the heat exchangers 12 and causing it to fall down into the hood 38. Once in the hood 38, the ice-water mixture is then pumped into the storage tank (not shown), where the ice is separated, and the water is pumped back into the ice machine 10. A plurality of insulation panels 60 are bolted to the frame, creating a thermally insulated compartment.

With reference to FIGS. 4-10, embodiments of the scraping devices are shown. FIG. 4 shows an outer scraping device 26 which comprises a carrier tube 54 that is bolted to the shaft 16 by use of base plate 56 (shown in FIG. 5). Welded at the end of the carrier tube 54 is top web 62, shown in FIG. 6B, while middle webs 64 (shown in FIG. 6C) are spaced evenly along the tube 54, and bottom web 66 (FIG. 6D) is welded at the base of the tube 54, near the shaft 16. A plurality of scrapers 58 extend along the length of the carrier tube 54, secured to the webs, by a pivot shaft 68, shown in FIG. 7, where its shoulder 70 secures it in place. The scrapers 58 are preferably plastic for producing slurry ice, and metal for flake ice.

Figure 6A:
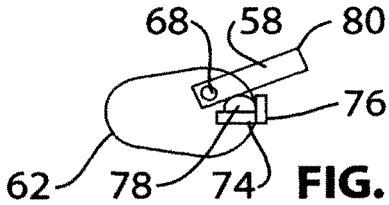
FIG. 6A is a top view of the top web from the scraping device in FIG. 4 with a scraper connected to it.
Figure 6B:
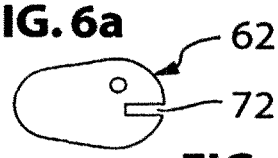
FIG. 6B is a top view of the top web from FIG. 6A without the scrapers.
Figure 7:
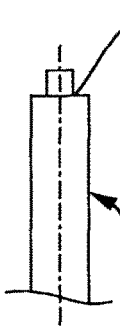
FIG. 7 is a side view of a pivot shaft, connecting the scraper to the web.
Figure 6C:
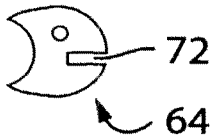
FIG. 6C is a top view of a middle web of a scraper.
Figure 5:
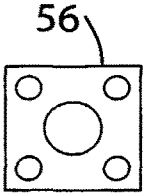
FIG. 5 is an end view of a base plate, connecting the scraping device to the shaft.

Referring to FIGS. 6A and 6B, resting in the slot 72 in each web is a first bar 74, which has a second bar 76 welded to both the first bar 74 and the web. Resting between the first bar 74 and the second bar 76 is a rubber bumper 78. This rubber bumper 78 pushes the scraper 58 away from bar 74, and pushes the scraper corner 80 against the flat plate heat exchanger 12. The shape of the scraper 58 allows it to be simply reversed when corner 80 wears off and use a second corner, thereby extending the life of the scraper. Along the opposite side of the carrier tube 54 from the scrapers 58, is a plurality of nozzles 36. As the water is pumped into the shaft 16, it travels up through the interior of the carrier tube 54, and is sprayed out the nozzles 36, as the tube 54 rotates with the shaft.

FIG. 8 shows an inner scraping device 28, which is used between two flat plate heat exchangers 12. There is an inner carrier 82, which is welded to the base plate 56 (FIG. 5) and bolted to the shaft 16. An additional, hollow carrier 84 slides over the inner carrier 82, encasing it. A removable bolt 86 secures the hollow carrier 84 to the inner carrier 82, and by doing so, to the shaft 16. A plurality of webs 88 are welded to the hollow carrier 84. There are two groups of scrapers 58, which are secured to the web 88 by two separate pivoted shafts 68 (shown in FIG. 7). Each pair of scrapers 58 along the length of the carrier 84 are separated by a bumper 78. A bar 90 is welded to the webs 88 and secures bumpers 78 in place. The bumpers 78 push the scrapers 58 away from each other and towards their respective heat exchange plates 12. This design allows for easy maintenance of the inner scraping devices. Rather than remove the flat plate heat exchangers 12, all that is needed is to remove the bolt 86 and the hollow carrier 84 may be slid out from between the heat exchangers. Furthermore, because the carrier 84 is less than half of the diameter of the heat exchanger 12, the necessary service area around the ice machine is small.

Figure 10:
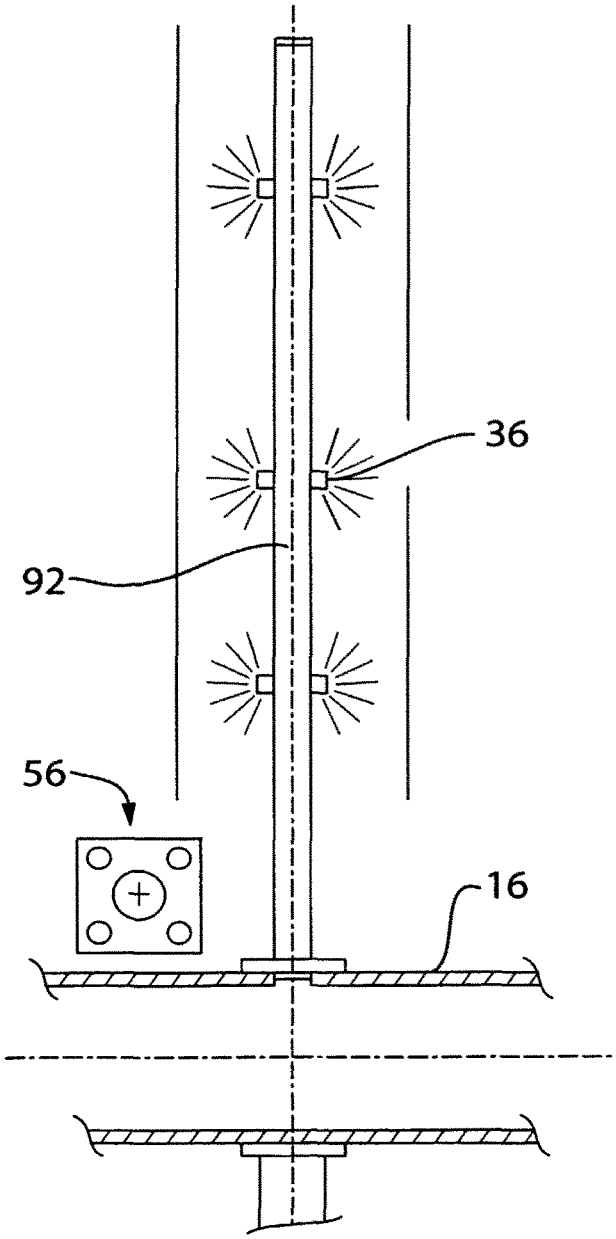
FIG. 10 is a side view of the spray tube used with the scraping device in FIG. 8.

Shown in FIG. 10, on the opposite side of the shaft 16 from the inner carrier 82 is a spray tube 92 which is welded to a base plate 56 and bolted to the shaft 16. Along the length of the spray tube 92 is a plurality of nozzles 36. As the water flows into the shaft 16, it flows through the spray tube 92, and out through the nozzles 36, spraying water on the heat exchanger 12 surfaces.

Figure 16:
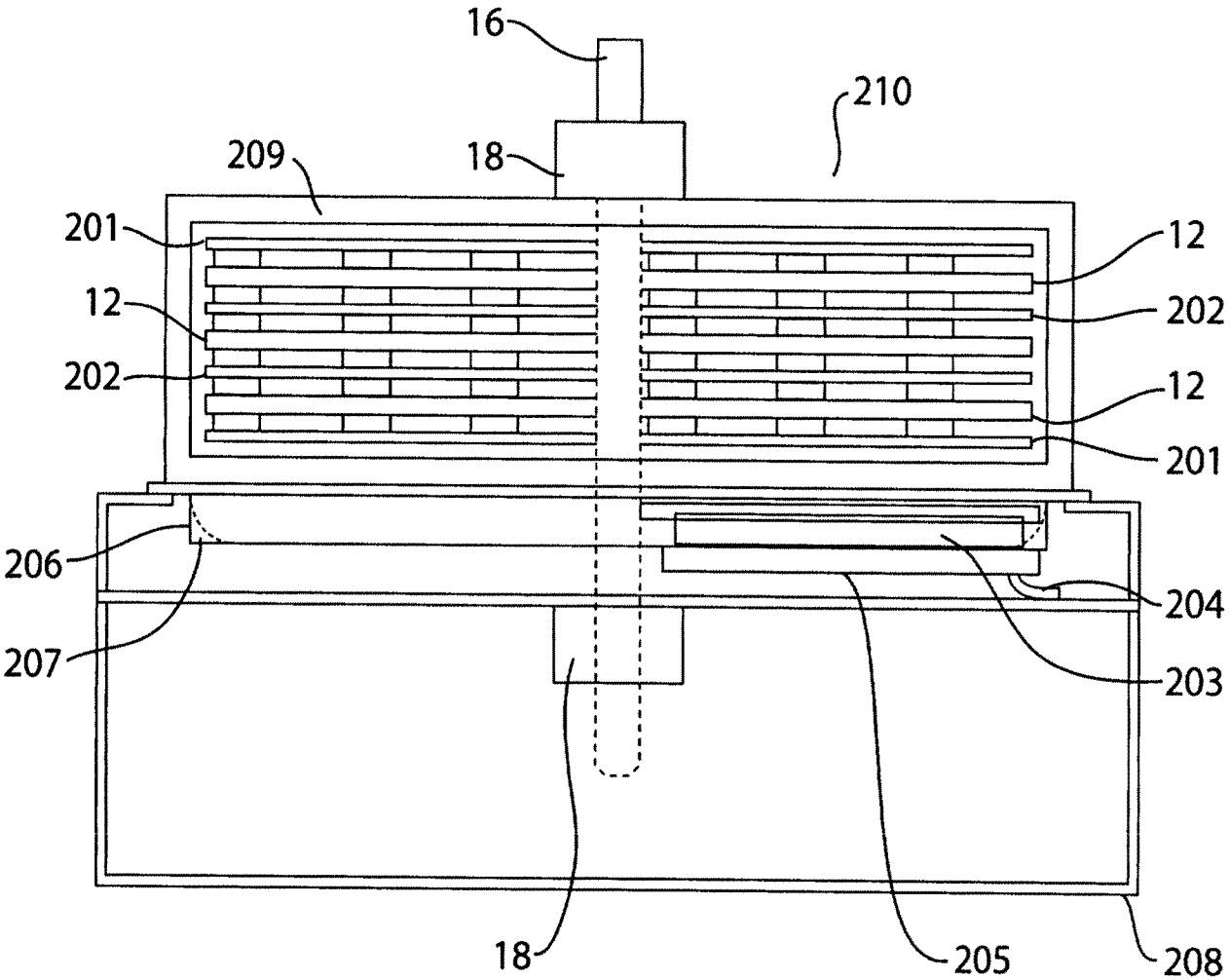
FIG. 16 is a front view of an alternative embodiment of the ice machine where the heat exchangers are situated horizontally.

FIG. 16 shows an alternative embodiment of the ice making machine with plates situated horizontally. This is advantageous in situations where height is limited, for example on board a fishing vessel. Referring to FIG. 16, where like parts have been numbered similarly, ice making machine 210 comprises a plurality of flat plate heat exchangers 12 within a top frame 209 supported by a bottom frame 208. Passing through the heat exchangers 12 which are aligned horizontally in a generally parallel position is a central shaft 16, which is supported on the outside of the top frame 209 and under the collection pan 206 by a pair of bearing housings 18.

Figure 17:
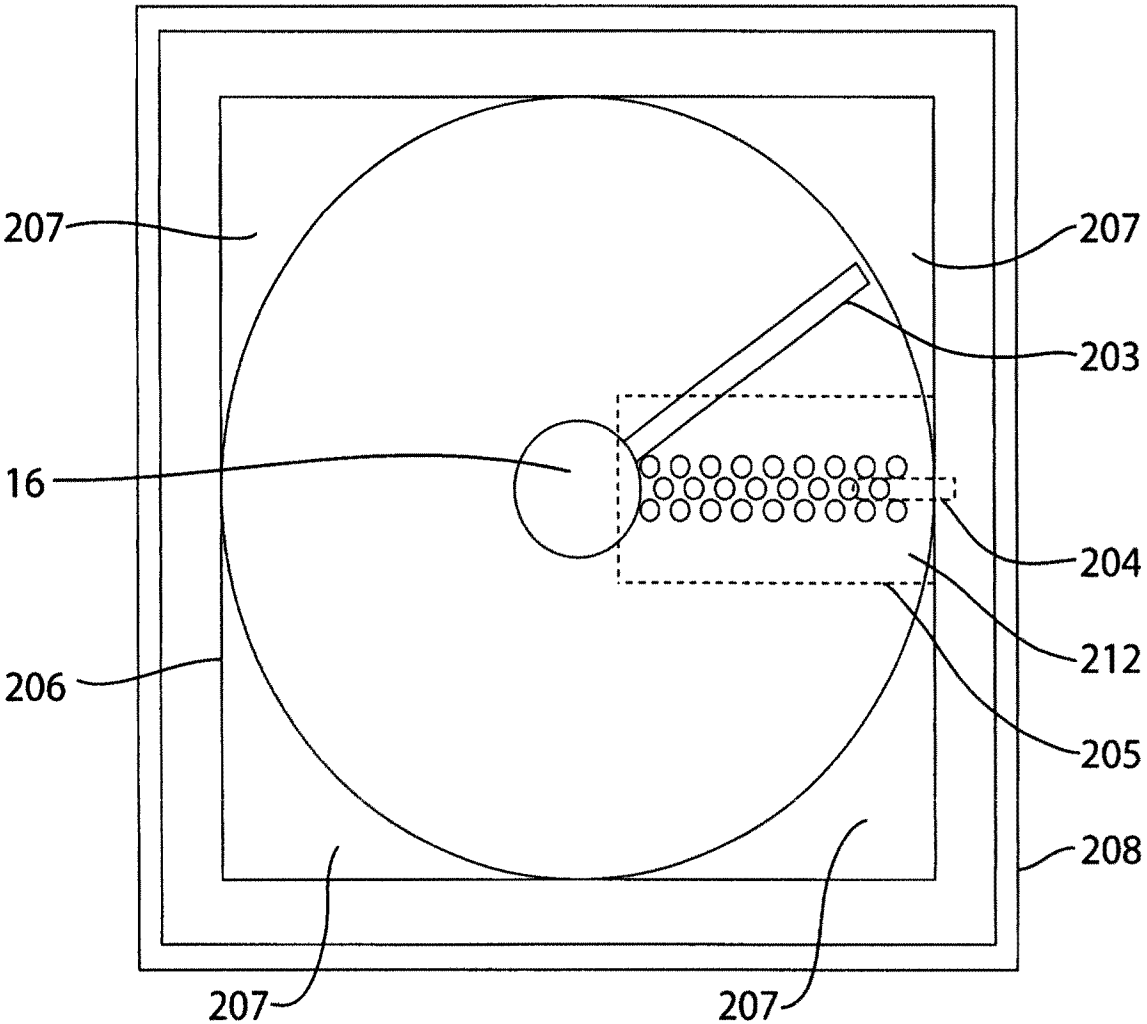
FIG. 17 is a top view of the collection pan and sweeper arrangement of the horizontal embodiment.
Figure 19:
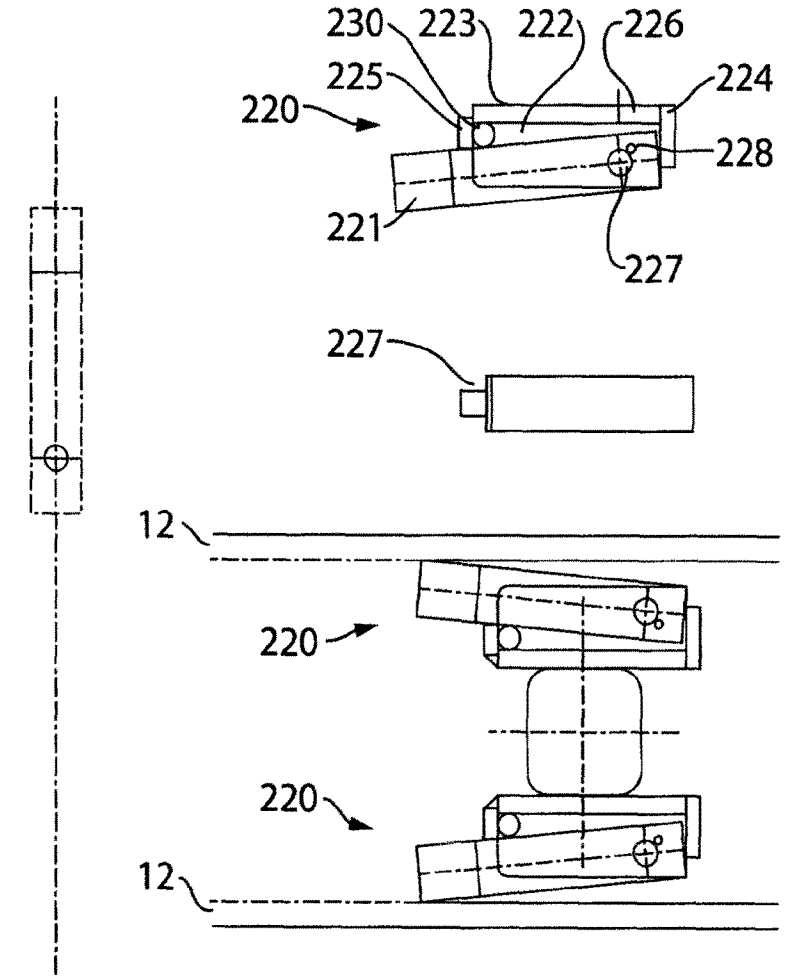
FIG. 19 is a side view of one pair of scrapers for simultaneously scraping two horizontal plates.

Between the outermost heat exchange plate and the top frame 209 is located an outer scraping device 201, while the inner scraping device 202 is located between two heat exchange plates 12. The refrigerant enters the machine 210 through a plurality of connections, and is then pumped into each heat exchanger 12. Fresh water, salt water or any other liquid to be frozen is pumped into the machine 210 through the shaft 16, then sprayed over the surface of the heat exchangers 12 from nozzles in the scraping devices 201, 202. The scraping devices 201, 202 are then rotated by the shaft 16, removing the ice-water mixture from the surface of the heat exchangers 12. The ice is pushed in an outward direction directed by orienting the scraping devices 202, 201 towards the outside. When the ice passes the outermost edge of the plate 12, it falls down into the pan 206. FIG. 17 shows a top view of the pan 206. In the pan 206 is a sweeping device 203 attached to the shaft 16, which rotates together with the shaft 16, sweeping the ice that has fallen into the pan 206. The pan has a perforated section 212. As the sweeper 203 passes the perforated section 212, the ice falls through the perforated section 212 and lands in the sump 205. Ice is then pumped out of the ice machine through outlet 204 into the storage tank (not shown), where the ice is separated, and the water is pumped back into the ice machine 210. Bevelled corners 207 ensure that when the ice falls into the pan 206, it slides down into the section of the pan 206 reached by the sweeper 203.

Figure 18:
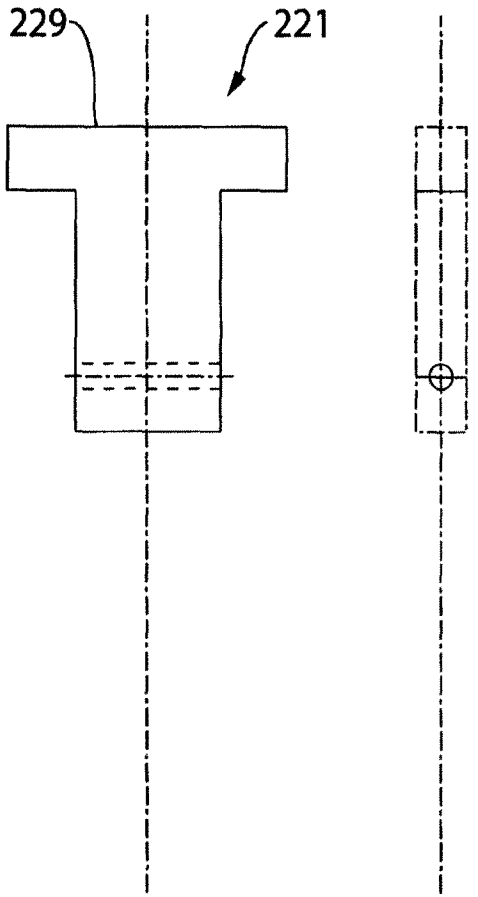
FIG. 18 is a top view of the scraping device for use with horizontal plates.
Figure 20:
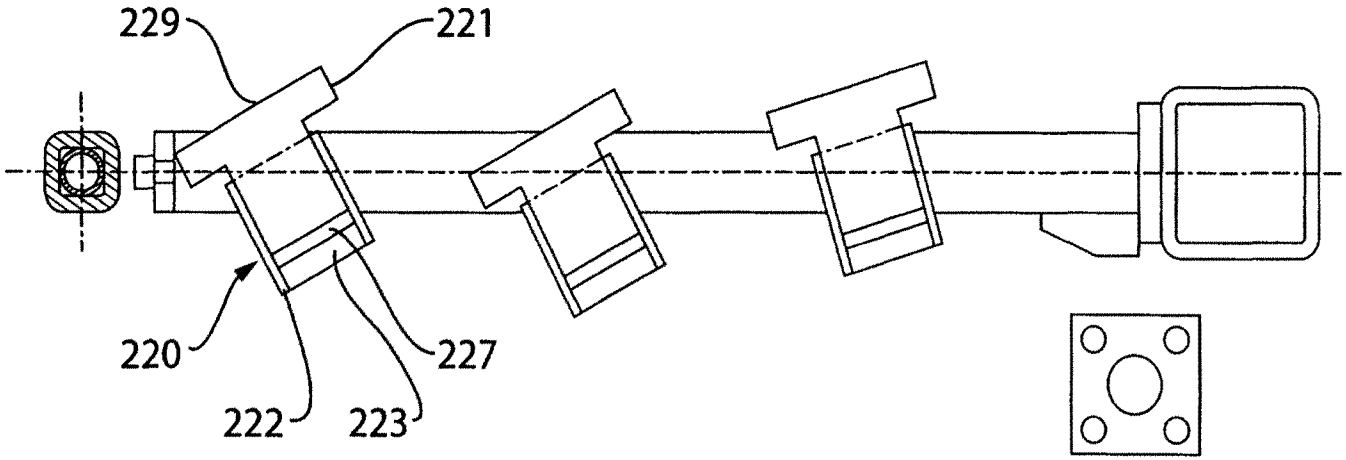
FIG. 20 is a side view of a single scraping element for scraping a horizontal plate.
Figure 21:
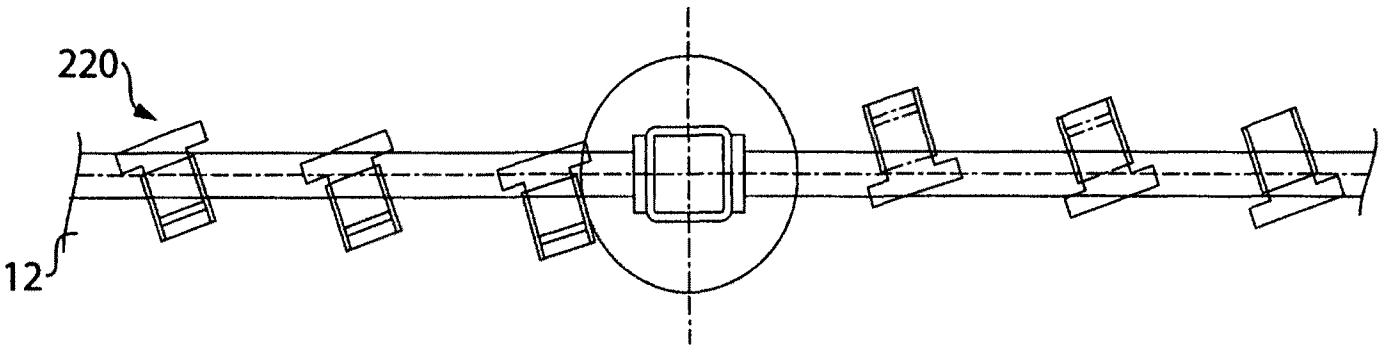
FIG. 21 is a top view of the scraping element that is in contact with the horizontal plate.

Scraping devices 201, 202 are shown in FIG. 18, and comprise a carrier with a plurality of scrapers 220. Each scraper 220 has a holder 223 with a top section 226, a rear section 224, and a front section 225, and two side sections 222 for holding a scraping element 221. A compressible bumper 230 maintains outward pressure on the scraping element 221 keeping it in contact with the heat exchange plate 12.

Scrapers 220 are spaced along the carrier such that successive scrapers 220 are separated by approximately the width of a single scraper 220. Scrapers 220 on opposite sides of the shaft are aligned along the carrier such that a circular path traced by any scraper 220 would pass through the scrapers on the opposite side. Scraping elements 221 have scraping edges 229 that are angled outwardly so as to push the ice towards, and finally over, the edge of the plate 12. Successive scraping elements may be angled increasingly outward such that those close to the shaft are angled closer to parallel to the direction of the length of the carrier, and those close to the edge of the plate 12 are aligned closer to perpendicular to the direction of the length of the carrier. The differently angled scraping elements is not essential to the design. Pin 227 is used to connect scraping element to the holder 223, while a screw secured in thread 228 keeps the pin 227 in place.

In the case of an outer scraping device 201 that scrapes the outermost side of an outer plate 12, the scrapers 220 would be welded to a carrier bolted to the shaft. Inner scraping devices 202, that are situated between two plates and scrape the sides of those plates simultaneously, have the scrapers 220 welded to a hollow carrier, which is then slid over an inner carrier 82 which is bolted to the shaft. Nozzles (not shown) are directed at the plates 12 from the carrier in order to spray the liquid to be frozen.

In the figures, the inner layer is shown as being made up of a plurality of sections, which fit together in a puzzle-like fashion. Each section is described as including a plurality of wall portions and foot portions, defining a plurality of flow channels all of which are integrally joined as part of that section. It is alternatively possible for each wall portion 47 to be an individual piece, which has a foot portion 51 integrally connected thereto along one or both longitudinal edges 49. In other words, it is optionally possible for each wall portion with its associated one or two foot portions 51 to be an individual piece that is individually connected to the outer plates.

In the figures, the ice making machine includes scrapers for scraping both sides of each heat exchanger. It is alternatively possible for one or more heat exchangers to have only a single scraper for scraping one side thereof.

In the figures, the ice-making machine has been shown to include a plurality of heat exchangers 12. It is alternatively possible for any of the ice making machines to include a single heat exchanger 12. In such an alternative, the machine may include an outer scraper 26 on one or both outer surfaces, however, it will be understood that the inner scraper 28 would not be included.

The ice-making machine 10 has been described as providing liquid to be frozen via a liquid source through the liquid supply system 17 to be ejected from the nozzles 36. It is alternatively possible to provide the liquid to be frozen in another way. For example, referring to FIG. 22, a sealed housing 97 may be provided that defines an internal chamber 99, in which is positioned the heat exchangers 12 and the scrapers 26 and 28. Liquid to be frozen may be introduced into the chamber 99 via a chamber inlet (not shown) that may be positioned anywhere suitable, such as on one side wall of the housing 97. The chamber 99 may be substantially filled with the liquid to be frozen. Thus, the heat exchangers 12 are submerged in the liquid to be frozen. As ice forms on the heat exchangers 12, the scrapers 26 and 28 scrape off the ice. The ice may be collected by any suitable means, such as by collecting it in a suitable conduit connected at the top of the chamber 99.

Figure 22:
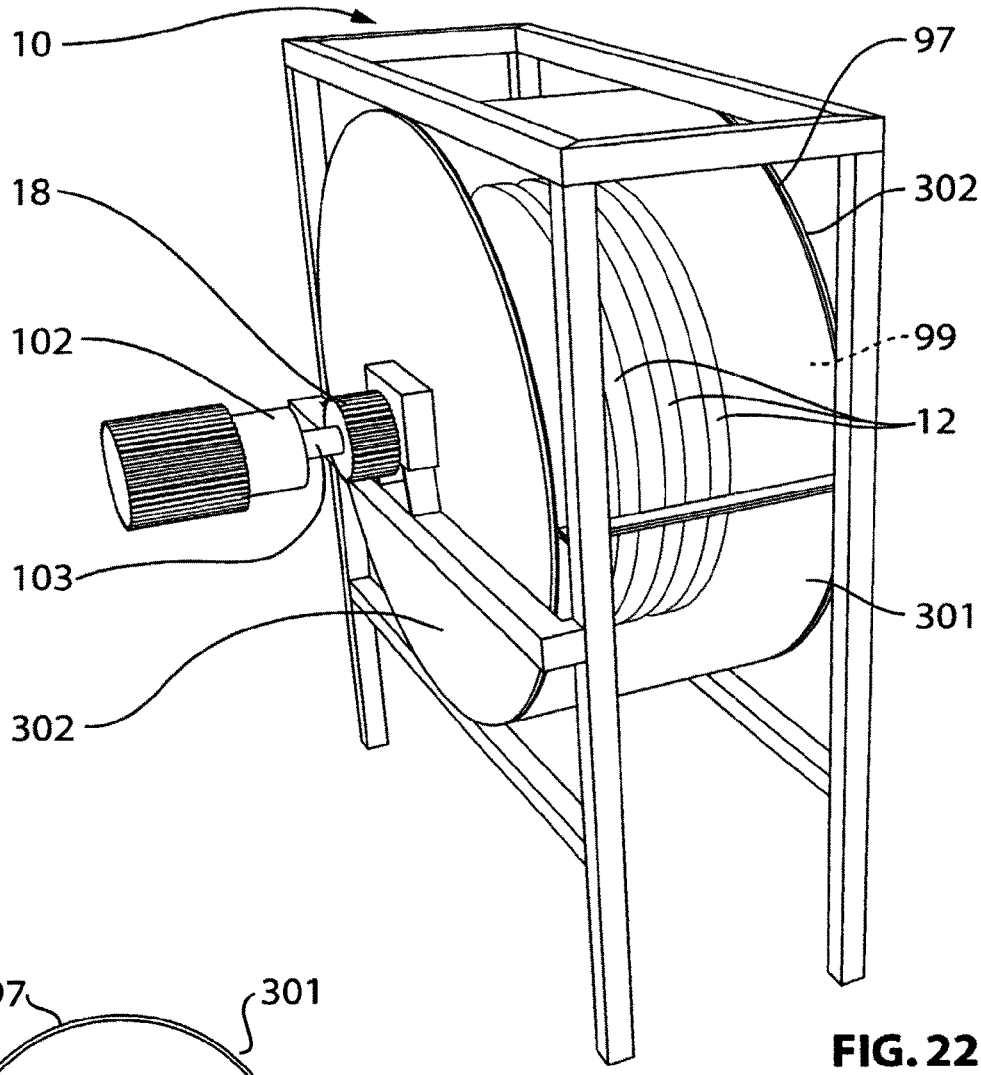
FIG. 22 is a perspective partially transparent view of an ice-making machine in accordance with another embodiment of the present invention.
Figure 22A:
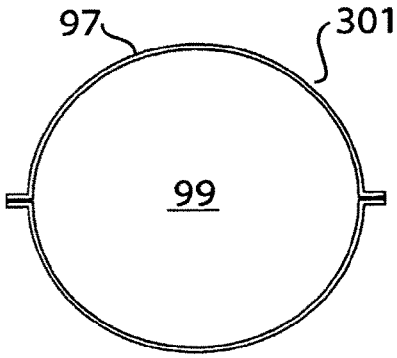
FIG. 22*a* is a side view of the housing shown in FIG. 22.

Referring to FIG. 22*a*, the sealed housing 97 may be generally cylindrical in shape, and may be comprised of one or two sheets 301 of flat, preferably insulated material bent into a cylindrical shape and sealed at its edges. The chamber 99 is sealed at its ends by two preferably insulated end panels 302 (FIG. 22). Alternatively, the sealed housing may be generally rectangular in shape.

The housing 97 seals about the rotating shaft 16 that passes therethrough to prevent leakage of the liquid to be frozen. This seal can be accomplished by any suitable means, such as by a plurality of packing rings.

Alternative configurations of the machine 10 are possible. When configured as a chiller, which cools but does not freeze the liquid, the scraper system 15 is not required. Liquid may brought into contact with the heat exchangers 12 by pumping the liquid into and out of the chamber 99. The rate of pumping determines the degree to which the liquid is cooled by the heat exchangers 12.

While the above description constitutes embodiments of the present invention, it will be appreciated that the present invention is susceptible to modification and change without departing from the fair meaning of the accompanying claims.

What is claimed is:

1. An apparatus for scraping material from first and second parallel plates, comprising:

a) a shaft passing perpendicularly through the first and second plates;

b) an inner carrier secured to the shaft and positioned perpendicular to the shaft parallel to the first and second plates;

c) a hollow outer carrier positioned between the first and second plates and removably connected to the inner carrier so that the inner carrier is in sliding engagement within the hollow outer carrier;

d) a plurality of scrapers positioned along the length of the hollow outer carrier; and e) means for keeping the scrapers in contact with the first and second plates.

2. The apparatus of claim 1, further comprising means for rotating the inner carrier in a plane parallel to the first and second plates.

3. The apparatus of claim 1, wherein the plurality of scrapers includes first and second sets of scrapers, each of the first and second sets of scrapers being maintained in contact with one of the first and second plates.

4. The apparatus of claim 1, wherein the inner carrier is secured to the shaft by a base plate.

5. The apparatus of claim 1, wherein the the inner carrier is removably connected to the hollow outer carrier by a removable bolt.

6. The apparatus of claim 3, wherein the scrapers are plastic.

7. The apparatus of claim 3, wherein the first and second sets of scrapers are maintained in contact with the first and second plates, respectively, by a rubber bumper, the outer carrier and the rubber bumper orienting the first and second sets of scrapers in a V-shaped configuration in relation to one another, wherein the first and second sets of scrapers buttress one another from opposite sides of the rubber bumper to maintain contact with the first and second plates, respectively.

8. The apparatus of claim 3, wherein each of the scrapers includes a first edge and a second edge, and wherein the scrapers are reversible to permit either the first edge or the second edge to be maintained in contact with one of the first and second plates.

9. An apparatus of claim 7, wherein the first and second plates are first and second adjacent plates, respectively, of first and second adjacent flat plate heat exchangers mounted on the shaft; wherein the first and second sets of scrapers are positioned along the length of the outer carrier; and wherein the rubber bumper maintains each of the first and second sets of scrapers in contact with one of the first and second adjacent plates.

10. An apparatus of claim 9, wherein each of the first and second flat plate heat exchangers comprises a refrigerant inlet, a refrigerant outlet, a first outer plate, a second outer plate, and an inner layer sealedly sandwiched between the first and second outer plates; wherein each of the first and second outer plates has an inner surface and an outer surface; wherein the inner layer at least in part defines a series of fluid channels through which a refrigerant flows;

wherein each of the series of fluid channels is defined in part by the inner surface of one of the first and second outer plates and by the inner layer; and wherein the series of fluid channels provides a flow path between the refrigerant inlet and the refrigerant outlet.

11. The apparatus of claim 1, further comprising a plurality of nozzles operable for spraying a liquid on the first and second plates.

12. The apparatus of claim 1, wherein the inner carrier is secured to a first side of the shaft, the apparatus further comprising:

a tube secured to a second side of the shaft opposite the first side; and a plurality of nozzles in the tube operable for spraying a liquid on the first and second adjacent plates.

13. The apparatus of claim 9, wherein the inner carrier is secured to a first side of the shaft, the apparatus further comprising:

a tube secured to a second side of the shaft opposite the first side; and a plurality of nozzles in the tube operable for spraying a liquid on the first and second plates.

* * * * *